US010923871B2

(12) United States Patent
Okuda et al.

(10) Patent No.: US 10,923,871 B2
(45) Date of Patent: Feb. 16, 2021

(54) MANUFACTURING METHOD OF CRIMPING TERMINAL

(71) Applicant: Yazaki Corporation, Tokyo (JP)

(72) Inventors: Yuta Okuda, Shizuoka (JP); Keiichiroh Kurashige, Shizuoka (JP); Kazuhide Takahashi, Shizuoka (JP); Hirohito Nakata, Shizuoka (JP); Syunsuke Yaoita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 514 days.

(21) Appl. No.: 15/725,794

(22) Filed: Oct. 5, 2017

(65) Prior Publication Data

US 2018/0109058 A1 Apr. 19, 2018

(30) Foreign Application Priority Data

Oct. 13, 2016 (JP) ..... 2016-201868

(51) Int. Cl.
*H01R 43/048* (2006.01)
*H01R 4/18* (2006.01)

(52) U.S. Cl.
CPC ..... *H01R 43/048* (2013.01); *H01R 43/0488* (2013.01); *H01R 4/185* (2013.01); *Y10T 29/49185* (2015.01)

(58) Field of Classification Search
CPC ..... H01R 43/048; H01R 43/0488; Y10T 29/49185; Y10T 29/49181;
(Continued)

(56) References Cited

U.S. PATENT DOCUMENTS 5,281,170 A * 1/1994 Murphy
6,068,527 A 5/2000 Ohsumi et al.
(Continued)

FOREIGN PATENT DOCUMENTS

CN 1702924 A 11/2005
CN 101931129 A 12/2010
(Continued)

OTHER PUBLICATIONS

Japanese Office Action for the related Japanese Patent Application No. 2016-201868 dated Sep. 4, 2018.
(Continued)

*Primary Examiner* — Peter Dungba Vo
*Assistant Examiner* — Azm A Parvez
(74) *Attorney, Agent, or Firm* — Kenealy Vaidya LLP

(57) ABSTRACT

A manufacturing method of a crimping terminal includes a terminal supply step of supplying the crimping terminal to a crimping position with a wire by a terminal supply device, the crimping terminal including a terminal connection portion, a wire connection portion to be crimped onto the wire, and a joint portion linking side walls of the terminal connection portion and the wire connection portion, a support step of supporting a bottom portion of the crimping terminal supplied to the crimping position by a first mold, a crimp step of deforming the wire connection portion while relatively moving toward the first mold, and crimping the wire connection portion onto the wire by a second mold, and a regulation step of regulating a width of the joint portion so as not to be wider than a width of the terminal connection portion, by sandwiching the joint portion from both sides in a width direction when the second mold crimps the wire connection portion by a regulation portion.

12 Claims, 16 Drawing Sheets

(58) Field of Classification Search
CPC ..... Y10T 29/49174; Y10T 29/49117; Y10T 29/49002
USPC ..... 29/836, 861, 857, 825, 592.1
See application file for complete search history.

(56) References Cited

U.S. PATENT DOCUMENTS

| | | | |
|---|---|---|---|
| 2003/0022563 | A1 | 1/2003 | Ohsumi et al. |
| 2005/0260897 | A1 | 11/2005 | Nimura |
| 2010/0319192 | A1 | 12/2010 | Takahashi et al. |
| 2014/0033520 | A1 | 2/2014 | Nakagishi |
| 2015/0318654 | A1* | 11/2015 | Kawamura |

FOREIGN PATENT DOCUMENTS

| | | | | |
|---|---|---|---|---|
| CN | 103579884 | A | | 2/2014 |
| JP | 11-219769 | A | | 8/1999 |
| JP | 2012216492 | A | * | 11/2012 |
| JP | 2014-32794 | A | | 2/2014 |
| JP | 2014-120422 | A | | 6/2014 |
| JP | 2015-146322 | A | | 8/2015 |
| JP | 2016-149196 | A | | 8/2016 |

OTHER PUBLICATIONS

Chinese Office Action for the related Chinese Patent Application No. 201710947827.7 dated Jan. 8, 2019.

* cited by examiner

MANUFACTURING METHOD OF CRIMPING TERMINAL

CROSS-REFERENCE TO RELATED APPLICATION(S)

The present application claims priority to and incorporates by reference the entire contents of Japanese Patent Application No. 2016-201868 filed in Japan on Oct. 13, 2016.

BACKGROUND OF THE INVENTION

1. Field of the Invention

The present invention relates to a manufacturing method of a crimping terminal.

2. Description of the Related Art

There has been conventionally a crimping terminal swaged onto a wire. For example, Japanese Patent Application Laid-open No. 11-219769 discloses a technique of a mold for forming a terminal, in which a mold that pinches a wire tightening portion of a terminal is provided with a side wall lower mold and a side wall upper mold that pinch a side wall connecting to the wire tightening portion. A pressure surface substantially connecting to a pressure surface of a conductive upper mold is provided on one side of the side wall upper mold, and a tapered surface expanding toward the other end is provided on the other end side.

Some crimping terminals include a wire connection portion to be crimped onto a wire, a terminal connection portion to be connected to a counterpart terminal, and a joint portion linking the wire connection portion and the terminal connection portion. When the wire connection portion of such a crimping terminal is swaged onto the wire, the joint portion may deform to swell outward. As a result, in some cases, when the crimping terminal is accommodated into a cavity, a deformed portion damages the inside of the cavity.

SUMMARY OF THE INVENTION

The object of the present invention is to provide a manufacturing method of a crimping terminal that can suppress deformation of a crimping terminal in crimping.

In order to solve the above mentioned problem and achieve the object, a manufacturing method of a crimping terminal according to one aspect of the present invention includes a terminal supply step of supplying the crimping terminal to a crimping position with a wire by a terminal supply device, the crimping terminal including a terminal connection portion to be connected to a counterpart terminal, a wire connection portion to be crimped onto the wire, and a joint portion linking side walls of the terminal connection portion and the wire connection portion; a support step of supporting a bottom portion of the crimping terminal supplied to the crimping position by a first mold; a crimp step of deforming the wire connection portion while relatively moving toward the first mold, and crimping the wire connection portion onto the wire by a second mold; and a regulation step of regulating a width of the joint portion so as not to be wider than a width of the terminal connection portion, by sandwiching the joint portion from both sides in a width direction when the second mold crimps the wire connection portion by a regulation portion.

According to another aspect of the present invention, in the manufacturing method of the crimping terminal, it is preferable that the regulation portion includes a pair of wall surfaces configured to sandwich the joint portion from the both sides in the width direction, and a width of a clearance gap between the pair of wall surfaces corresponds to a width of the terminal connection portion.

According to still another aspect of the present invention, in the manufacturing method of the crimping terminal, it is preferable that the regulation portion includes a pair of wall surfaces facing each other in a width direction of the crimping terminal, the pair of wall surfaces include first regions facing side walls of the terminal connection portion, and second regions facing side walls of the joint portion, and when the second mold crimps the wire connection portion, a timing at which the first regions start to face the side walls of the terminal connection portion is earlier than a timing at which the second regions start to face the side walls of the joint portion.

According to still another aspect of the present invention, in the manufacturing method of the crimping terminal, it is preferable that the regulation portion moves integrally with the second mold.

According to still another aspect of the present invention, in the manufacturing method of the crimping terminal, it is preferable that further comprising a press step of pressing a bottom portion of the joint portion toward the first mold by a pressing mechanism provided in the regulation portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

A manufacturing method of a crimping terminal according to an embodiment of the present invention will be described in detail below with reference to the drawings. In addition, the present invention is not limited by the embodiment. In addition, components in the following embodiment include the ones easily-conceived by those skilled in the art, or the ones that are substantially identical.

Embodiment

Figure 12:
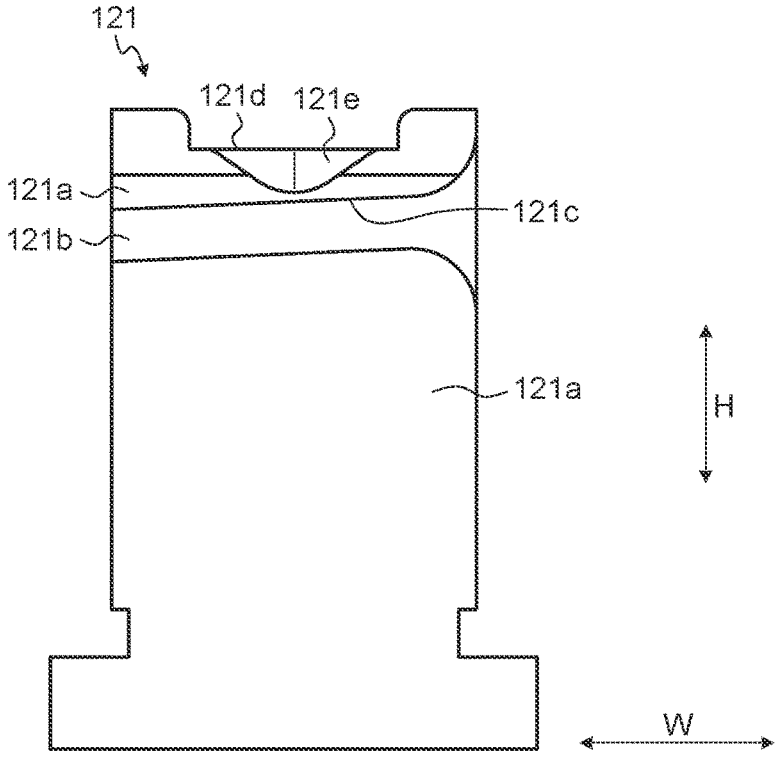
FIG. 12 is a rear view illustrating the terminal cutting member according to an embodiment.
Figure 13:
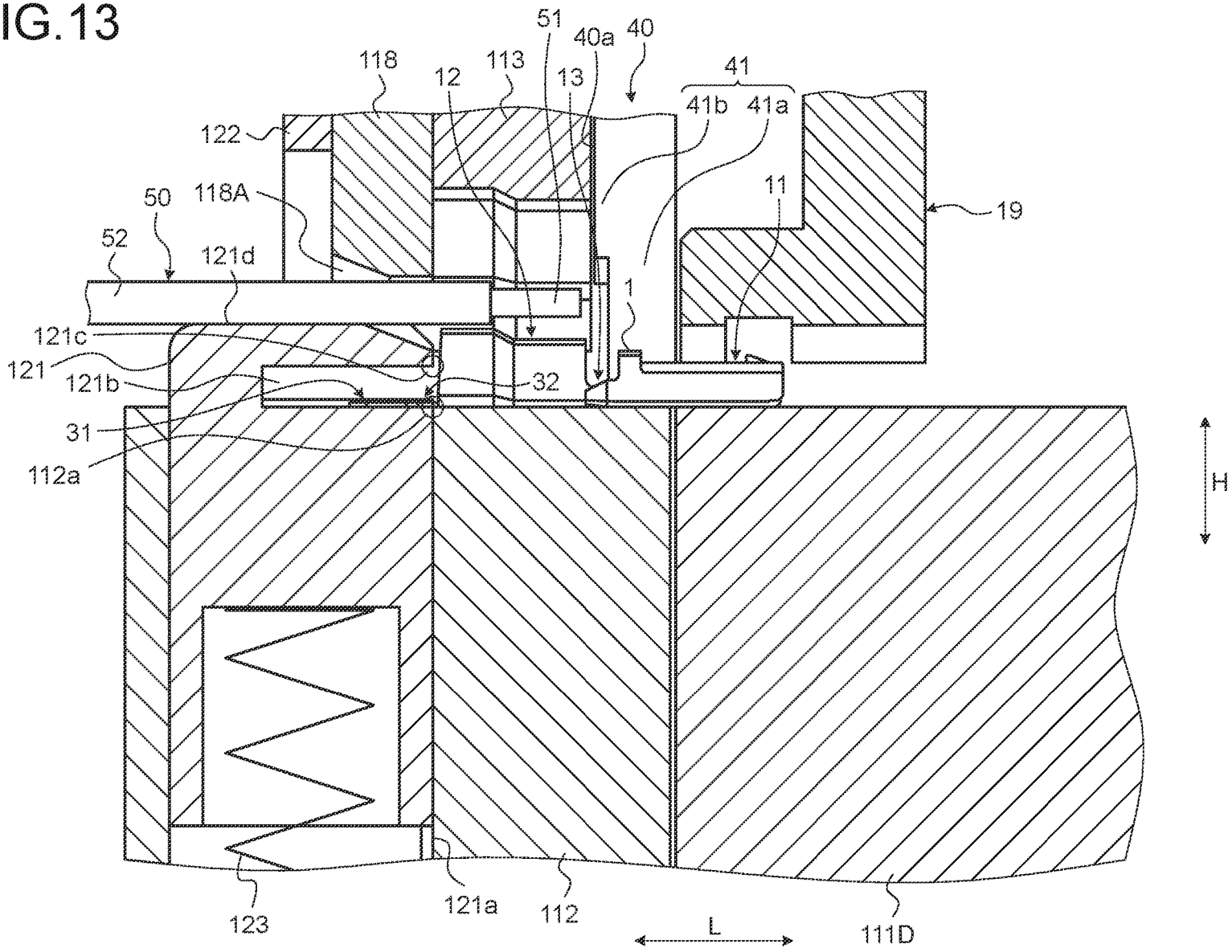
FIG. 13 is a cross-sectional view illustrating a state in which a wire and the crimping terminal are set in the terminal crimping apparatus according to an embodiment.

An embodiment will be described with reference to FIGS. 1 to 21. The present embodiment relates to a manufacturing method of a crimping terminal. In addition, FIG. 13 illustrates a XIII-XIII cross section in FIG. 9. In addition, a cross section at the same cross-sectional position as FIG. 13 is illustrated in a cross-sectional view in FIG. 20.

First of all, a crimping terminal 1 according to the present embodiment will be described. The crimping terminal 1 illustrated in FIG. 1 and the like is a terminal to be crimped onto a wire 50. The crimping terminal 1 is electrically-connected to a counterpart terminal (not illustrated) in a state of being integrated with the wire 50. A covering 52 at an end portion of the crimping target the wire 50 is removed, and a core wire 51 is exposed by a predetermined length. The core wire 51 may be an aggregate of a plurality of wires, or may be a single wire such as a coaxial cable. By being crimped to the end portion of the wire 50, the crimping terminal 1 is electrically-connected to the exposed core wire 51.

The crimping terminal 1 includes a terminal fitting 10 and a water stop member 20. The terminal fitting 10 is a main portion of the crimping terminal 1. The terminal fitting 10 is formed of a conductive metal plate serving as a base material (e.g., copper plate, copper alloy plate). The terminal fitting 10 is formed into a predetermined shape that enables connection to the other terminal and the wire 50, through punching processing, bending processing, and the like that are performed on the base material. The terminal fitting 10 includes a terminal connection portion 11 and a wire connection portion 12. The terminal connection portion 11 is a portion to be electrically-connected to the other terminal. The wire connection portion 12 is a portion to be crimped onto the wire 50, and is electrically-connected to the core wire 51. A joint portion 13 is provided between the terminal connection portion 11 and the wire connection portion 12. In other words, the terminal connection portion 11 and the wire connection portion 12 are joined via the joint portion 13. The joint portion 13 includes side walls 13*a* and 13*a* that link side walls 11*a* and 11*a* of the terminal connection portion 11 and barrel piece portions 15 and 16 being side walls of the wire connection portion 12. One side wall 13*a* links one side wall 11*a* and a first barrel piece portion 15, and the other side wall 13*a* links the other side wall 11*a* and a second barrel piece portion 16 (refer to FIG. 17). A height of the side walls 13*a* is lower than heights of the barrel piece portions 15 and 16, and the side walls 11*a*. More specifically, the height of the side walls 13*a* becomes lower from the terminal connection portion 11 toward the wire connection portion 12.

The terminal fitting 10 may be a male terminal or a female terminal. When the terminal fitting 10 is a male terminal, the terminal connection portion 11 is molded into a male die, and when the terminal fitting 10 is a female terminal, the terminal connection portion 11 is molded into a female die.

In the description of the crimping terminal 1, a direction in which the crimping terminal 1 is connected to the other terminal, that is, a direction in which the crimping terminal 1 is inserted into the other terminal will be referred to as a first direction L. The first direction L is a longitudinal direction of the crimping terminal 1. A parallel arrangement direction of the crimping terminals 1 will be referred to as a second direction W. As described later, the parallel arrangement direction is a direction in which the crimping terminals 1 are arranged in parallel in a terminal chain member 30, and is a width direction of the crimping terminal 1. In the crimping terminal 1, a direction perpendicular to both of the first direction L and the second direction W will be referred to as a third direction H. The third direction H is a height direction of the crimping terminal 1.

Figure 1:
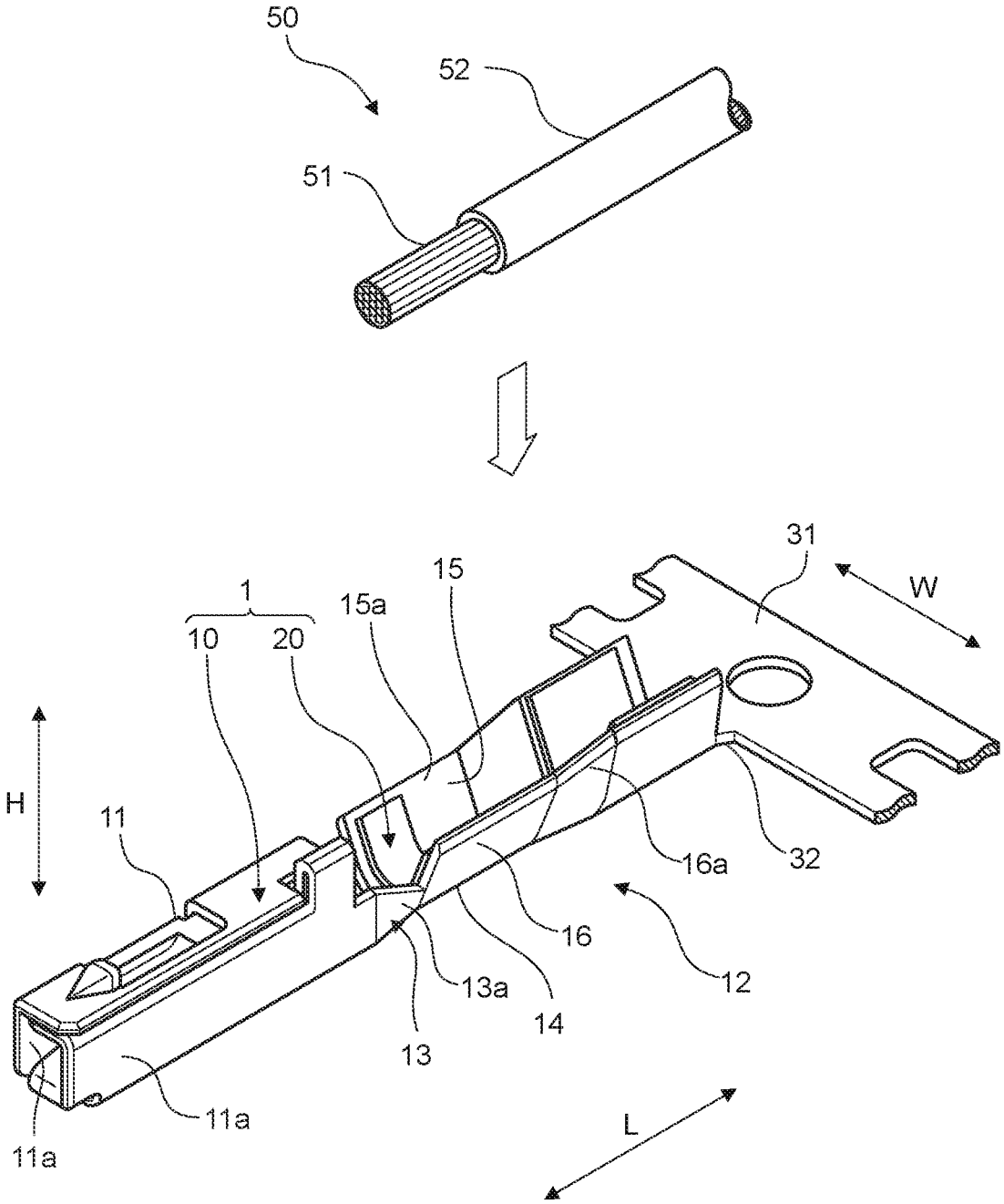
FIG. 1 is a perspective view illustrating a state before crimping of a crimping terminal according to an embodiment.
Figure 2:
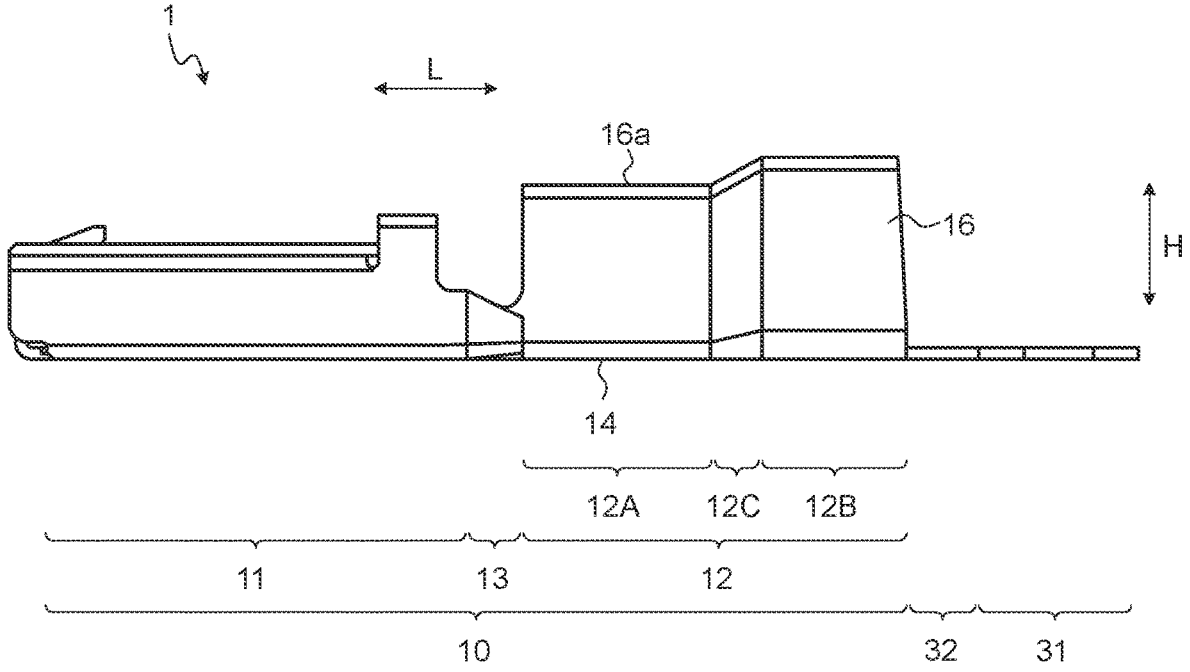
FIG. 2 is aside view illustrating a state before crimping of the crimping terminal according to an embodiment.
Figure 3:
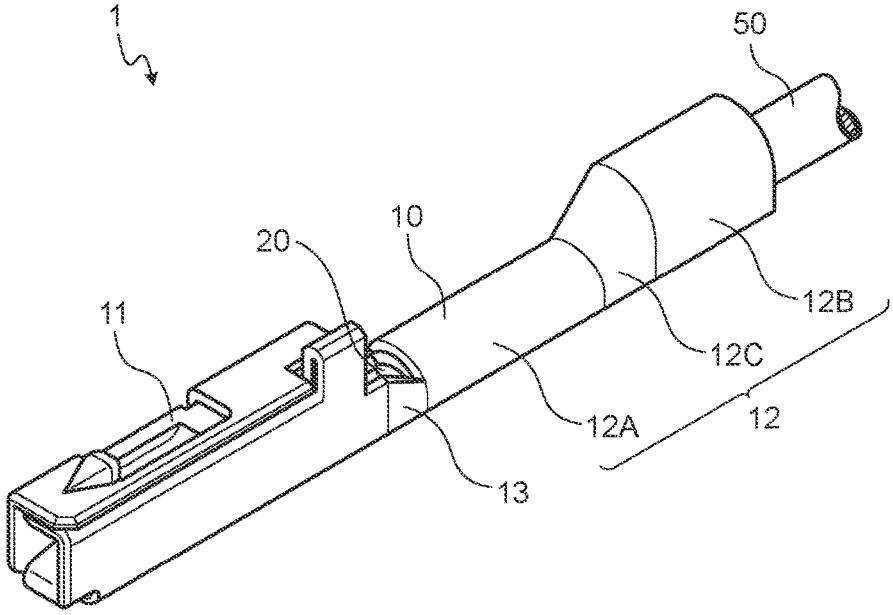
FIG. 3 is a perspective view illustrating the crimping terminal according to an embodiment that is obtainable after crimping.
Figure 4:
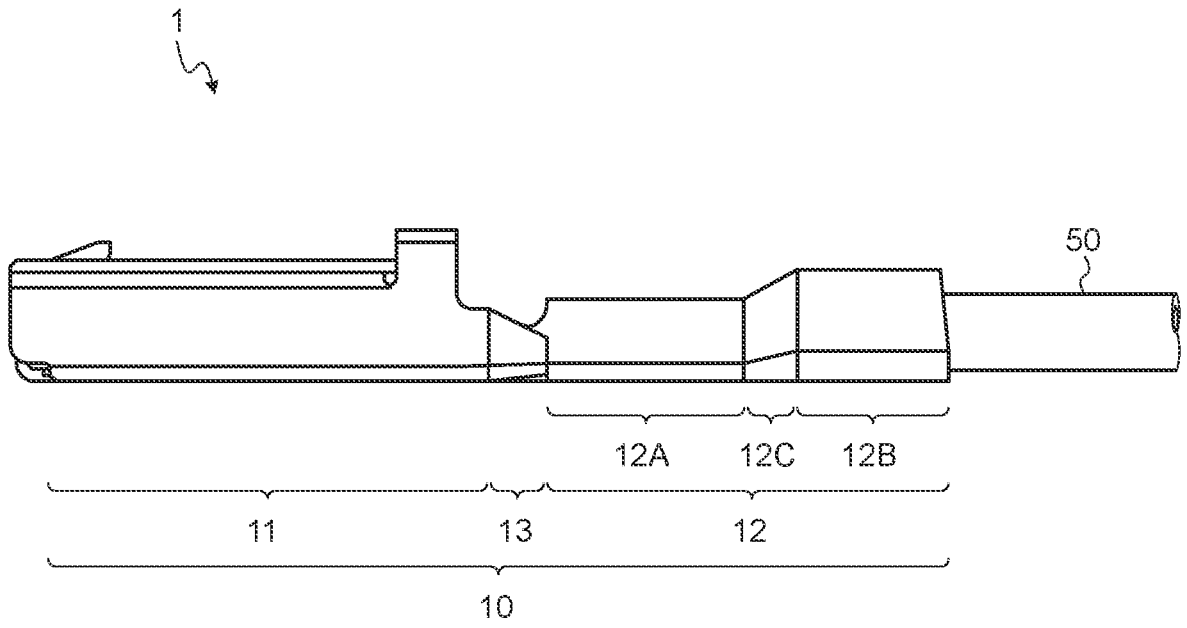
FIG. 4 is a side view illustrating the crimping terminal according to an embodiment that is obtainable after crimping.

In a molding process, the crimping terminal 1 is molded into a flat plate shape, and from this state, in a terminal connection portion shaping process, the terminal connection portion 11 is formed into a tubular shape as illustrated in FIG. 1. In the terminal connection portion shaping process, the bending processing and the like are performed on the terminal connection portion 11. The terminal connection portion 11 of the present embodiment is formed into a tubular shape having an oblong cross-sectional shape. In a wire connection portion shaping process, the wire connection portion 12 is molded so as to have a U-shaped cross-sectional shape. In the wire connection portion shaping process, the bending processing and the like are performed on the wire connection portion 12. In addition, the water stop member 20 is attached to the wire connection portion 12 in an attaching process. The attaching process may be executed before the wire connection portion shaping process, or may be executed after the wire connection portion shaping process.

Figure 6:
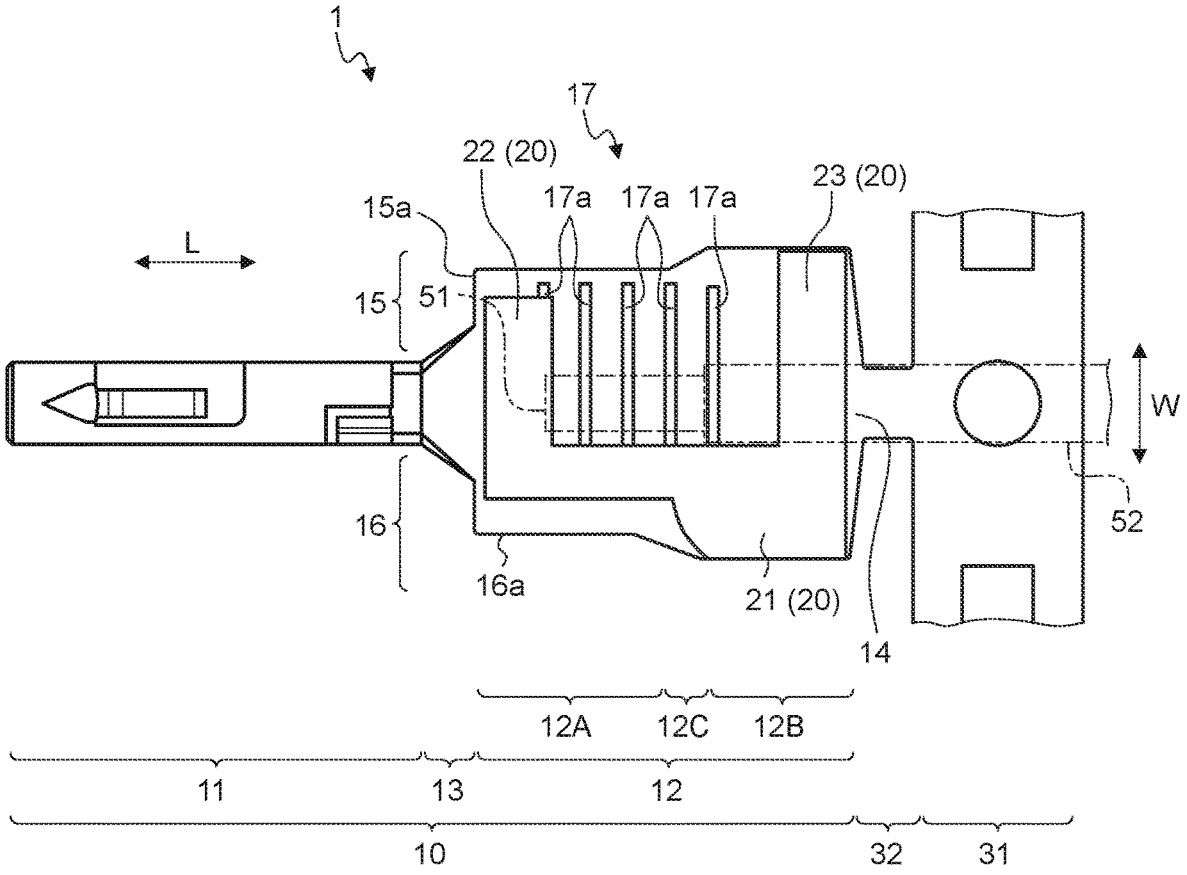
FIG. 6 is a plan view illustrating a state in which a water stop member is attached in the crimping terminal according to an embodiment.

As illustrated in FIGS. 1 and 6, the wire connection portion 12 includes a bottom portion 14, the first barrel piece portion 15, and the second barrel piece portion 16. The bottom portion 14 is a region serving as a bottom wall of the wire connection portion 12 formed into the U-shape. In crimping processing, the end portion of the wire 50 is placed on the bottom portion 14. The first barrel piece portion 15 and the second barrel piece portion 16 are regions serving as side walls of the wire connection portion 12 formed into the U-shape. The first barrel piece portion 15 and the second barrel piece portion 16 are connected to end portions in the second direction W of the bottom portion 14. In the wire connection portion 12 formed into the U-shape, when the end portion of the wire 50 is placed on the bottom portion 14, the first barrel piece portion 15 and the second barrel piece portion 16 surround the wire 50 from both sides in the second direction W.

Lengths from roots on the bottom portion 14 side to end surfaces of distal ends 15*a* and 16*a* of the first barrel piece portion 15 and the second barrel piece portion 16 may be equal to each other, or one length may be longer than the other length. In the crimping terminal 1 of the present embodiment, the length from the root to the distal end 15*a* of the first barrel piece portion 15 and the length from the root to the distal end 16*a* of the second barrel piece portion 16 are equal. For example, the first barrel piece portion 15 and the second barrel piece portion 16 are winded around the wire 50 while overlapping each other. In addition, swaging referred to as so-called B crimping may be performed on the first barrel piece portion 15 and the second barrel piece portion 16. In the B crimping, both of the first barrel piece portion 15 and the second barrel piece portion 16 are bent toward the bottom portion 14 side, and swaged so that the distal ends 15*a* and 16*a* are pressed against the wire 50. Because the crimping terminal 1 of the present embodiment is provided with the water stop member 20 to be described later, the former swaging processing is employed.

The end portion of the wire 50 is inserted into a U-shaped inner space from a U-shaped opening portion of the wire connection portion 12, that is, from a clearance gap between the distal ends 15*a* and 16*a*. The wire connection portion 12 is formed so that the end portion of the wire 50 can be easily inserted. More specifically, in the wire connection portion 12, a distance in the second direction W between the first barrel piece portion 15 and the second barrel piece portion 16 widens from the bottom portion 14 side toward the end surfaces of the distal ends 15*a* and 16*a*.

As illustrated in FIGS. 2 to 6, in the first barrel piece portion 15 and the second barrel piece portion 16, a joint crimping portion 12C interposes between a core wire crimping portion 12A and a covering crimping portion 12B. Each of the first barrel piece portion 15 and the second barrel piece portion 16 is one piece portion in which the crimping portions 12A, 12C, and 12B are consecutively arranged in the first direction L in this order. In addition, in the first barrel piece portion 15 and the second barrel piece portion 16, a slit may be provided between the core wire crimping portion 12A and the covering crimping portion 12B, and the crimping portions 12A and 12B may be connected to each other via the bottom portion 14.

The core wire crimping portion 12A is a region to be crimped onto the core wire 51 at the distal end of the wire 50. The core wire crimping portion 12A is a region closest to the joint portion 13 in each of the barrel piece portions 15 and 16. The covering crimping portion 12B is a region to be crimped onto an end portion of the covering 52. The covering crimping portion 12B is a region positioned on the farthest side from the joint portion 13 side in each of the barrel piece portions 15 and 16. The joint crimping portion 12C is a region linking the core wire crimping portion 12A and the covering crimping portion 12B. The joint crimping portion 12C is crimped onto a boundary portion between the core wire 51 and the covering 52 of the wire 50.

Figure 5:
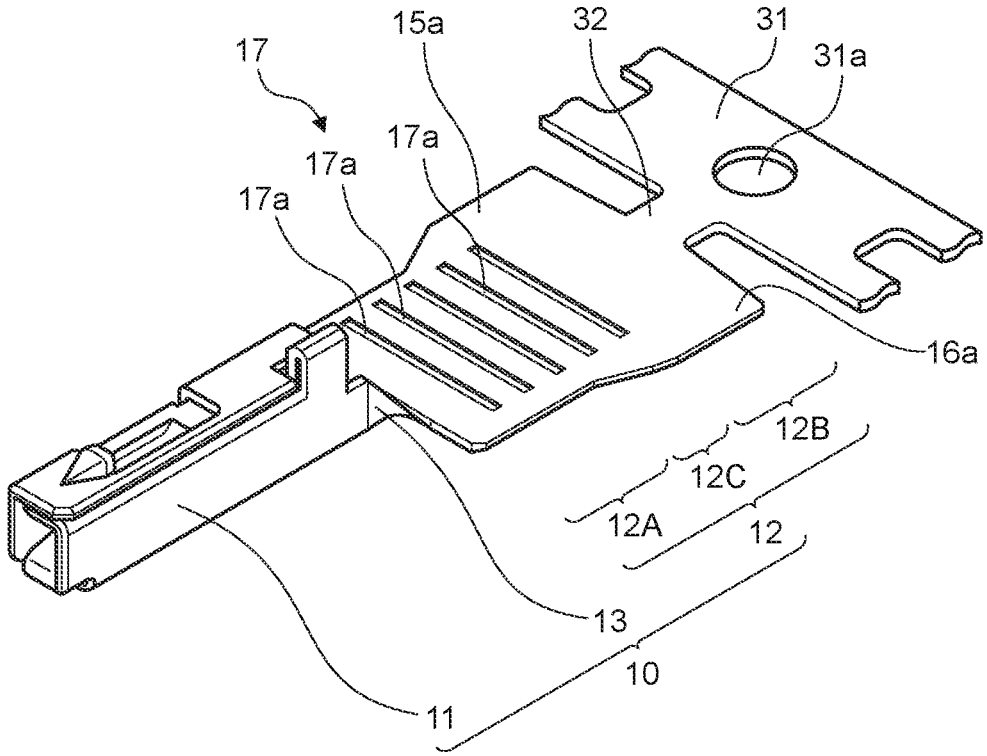
FIG. 5 is a perspective view illustrating a state before bending processing of a wire connection portion is performed in the crimping terminal according to an embodiment.

As illustrated in FIGS. 5 and 6, a serration region 17 is provided on an inner wall surface of the wire connection portion 12, that is, on a wall surface on the side covering the wire 50. The serration region 17 is a core wire holding region for holding the core wire 51. The serration region 17 is a region on the inner wall surface of the wire connection portion 12 that includes a portion to be winded around the core wire 51. A plurality of recessed portions, a plurality of projection portions, or combinations of recessed portions and projection portions are arranged on the serration region 17. The recessed portions and the projection portions increase a contact area between the wire connection portion 12 and the core wire 51 to enhance the strength of adhesion therebetween. The serration region 17 of the present embodiment is an oblong region, and a plurality of recessed portions 17*a* are formed at positions different from each other in the first direction L.

Here, ingress of water between the core wire 51 and the wire connection portion 12 crimped onto the core wire 51 is not preferable. For example, when the metal material of the core wire 51 and the metal material of the wire connection portion 12 have different-sized ionization tendencies, corrosion may occur. As an example, when the material of the core wire 51 is aluminum, and the material of the wire connection portion 12 is copper, the core wire 51 may corrode. The crimping terminal 1 of the present embodiment is provided with the water stop member 20. The water stop member 20 suppresses ingress of water between the wire connection portion 12 and the core wire 51.

For example, the water stop member 20 is a member formed into a sheet mainly containing adhesive such as acrylic adhesive. As the water stop member 20 of the present embodiment, an adhesive sheet being formed of sheet-like nonwoven cloth saturated with adhesive, and having an adhesive effect on the both sides is used.

For example, the water stop member 20 is attached onto the inner wall surface of the flat-plate-shaped wire connection portion 12 illustrated in FIG. 5. As illustrated in FIG. 6, the water stop member 20 is formed into a predetermined shape, and includes a first water stop portion 21, a second water stop portion 22, and a third water stop portion 23. After the completion of crimping, the first water stop portion 21 stops water ingress into an overlapping portion of the first barrel piece portion 15 and the second barrel piece portion 16. More specifically, the first water stop portion 21 forms a water stop region between the barrel piece portions 15 and 16 by being sandwiched between the first barrel piece portion 15 and the second barrel piece portion 16 overlapping each other. The first water stop portion 21 of the present embodiment is disposed in the second barrel piece portion 16, and extends in the first direction L.

The second water stop portion 22 stops water ingress into a portion on the terminal connection portion 11 side from the distal end of the core wire 51. The second water stop portion 22 is disposed at an end portion on the terminal connection portion 11 side of the wire connection portion 12, and extends in the second direction W. At least part of the second water stop portion 22 is desirably provided in a region in which the core wire 51 is placed. For example, the second water stop portion 22 forms a water stop region in a clearance gap between the barrel piece portions 15 and 16 by being sandwiched between the overlapping barrel piece portions 15 and 16. The second water stop portion 22 can also block a clearance gap provided on the terminal connection portion 11 side from the distal end of the core wire 51, by overlapping each other in a crimping process. The second water stop portion 22 suppresses ingress of water between the wire connection portion 12 and the core wire 51 from the terminal connection portion 11 side.

The third water stop portion 23 suppresses ingress of water from a clearance gap between the wire connection portion 12 and the covering 52. The third water stop portion 23 is disposed at an end portion on an opposite side of the terminal connection portion 11 side of the wire connection portion 12, and extends in the second direction W. The third water stop portion 23 forms a water stop region between the covering 52 and the wire connection portion 12 by being sandwiched between the covering 52 and the wire connection portion 12.

Through a press process performed on one metal plate serving as a base material, the above-described terminal fitting 10 is processed into a configuration having the flat-plate-shaped wire connection portion 12 illustrated in FIG. 5. In the subsequent water stop member attaching process, the water stop member 20 is attached to the flat-plate-shaped wire connection portion 12. After that, in the terminal fitting 10, in a bending process, the terminal connection portion 11 is formed, and the U-shaped wire connection portion 12 is formed.

Figure 7:
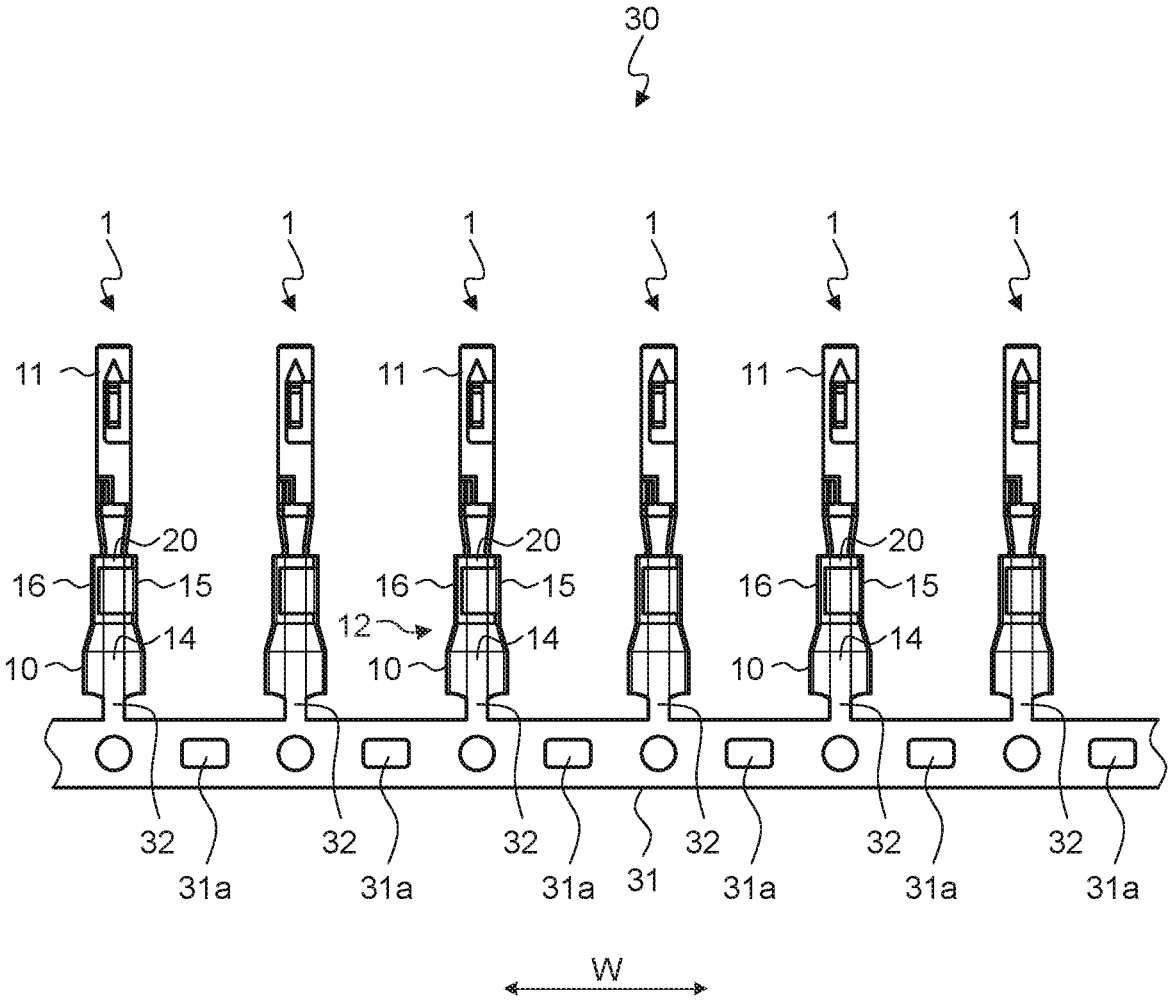
FIG. 7 is a plan view illustrating a terminal chain member according to an embodiment.

In the present embodiment, the terminal chain member 30 illustrated in FIG. 7 is formed through the press process and the bending process. The terminal chain member 30 is obtained by chaining a plurality of the crimping terminals 1, and is formed of one metal plate. The terminal chain member 30 is supplied to a terminal crimping apparatus 100. The terminal crimping apparatus 100 executes the crimping process and a terminal cutting process on the terminal chain member 30. The crimping process is a process of swaging and crimping the crimping terminal 1 of the terminal chain member 30 onto the wire 50. The terminal cutting process is a process of cutting off the crimping terminal 1 swaged to the wire 50, from the terminal chain member 30.

The terminal chain member 30 is an aggregate of the crimping terminals 1. The terminal chain member 30 includes a joint piece 31, the plurality of crimping terminals 1, and a plurality of link portions 32. The joint piece 31, the crimping terminals 1, and the link portions 32 are integrally formed of the same base material. In the terminal chain member 30, the crimping terminals 1 are oriented in the same direction, and arranged in parallel at equal intervals. In the terminal chain member 30, one end portions of the respective crimping terminals 1 are linked to each other by the joint piece 31. For example, the shape of the joint piece 31 is a thin and long oblong plate shape. The joint piece 31 extends in the second direction W. The wire connection portions 12 are connected to the joint piece 31 via the link portions 32. More specifically, the link portions 32 link the end portions on the opposite side of the terminal connection portion 11 side of the bottom portions 14 to the joint piece 31.

A plurality of terminal feed holes 31*a* are formed in the joint piece 31. The terminal feed holes 31*a* are arranged at equal intervals in a feed direction of the terminal chain member 30. The terminal feed holes 31*a* are through-holes penetrating through the joint piece 31 in a plate thickness direction. The crimping terminals 1 are positioned by the terminal feed holes 31*a* on a crimping device 102 to be described later. The terminal chain member 30 is set into the terminal crimping apparatus 100 in a state of being winded up in a reel shape.

Figure 8:
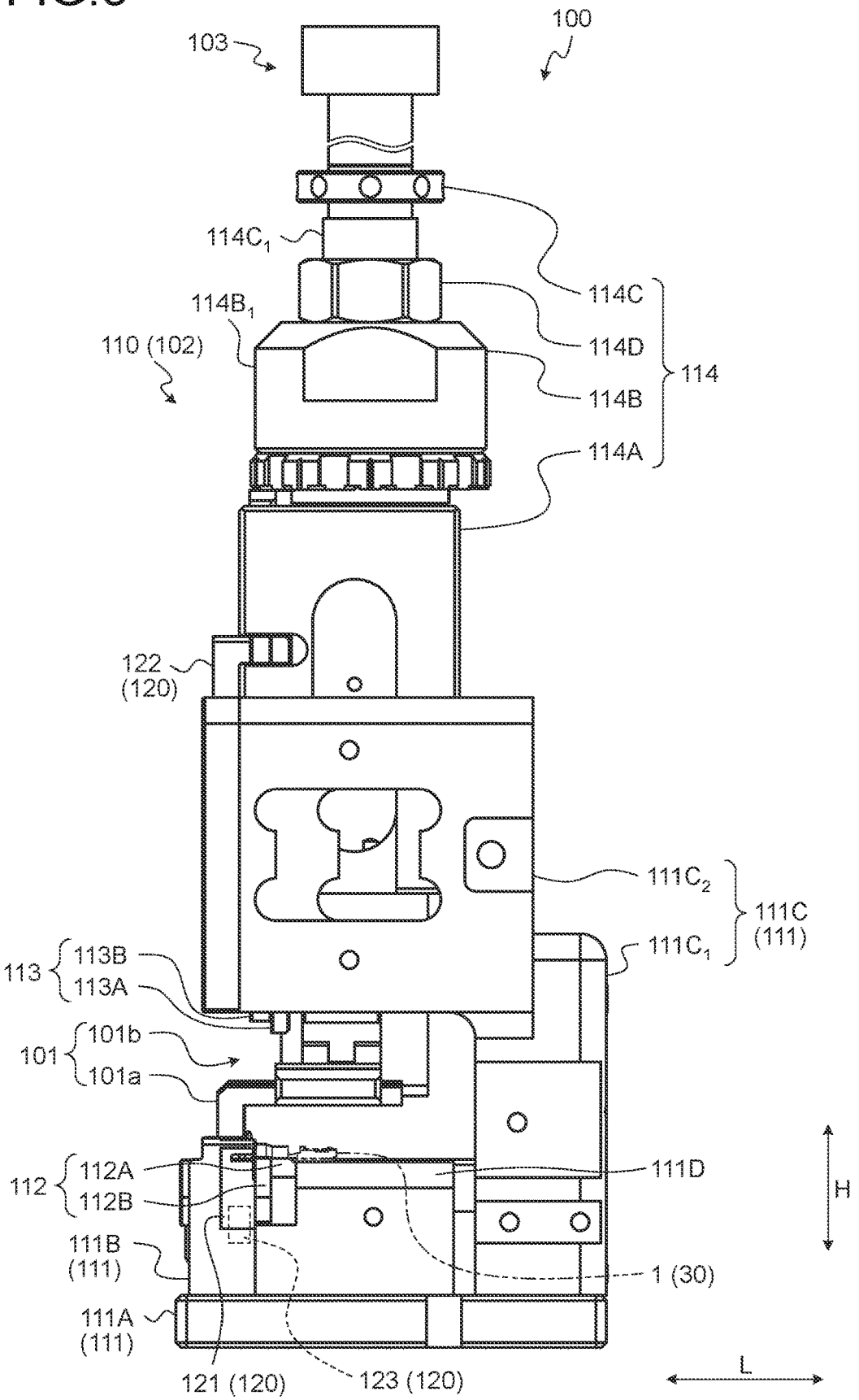
FIG. 8 is a side view of a terminal crimping apparatus according to an embodiment.
Figure 9:
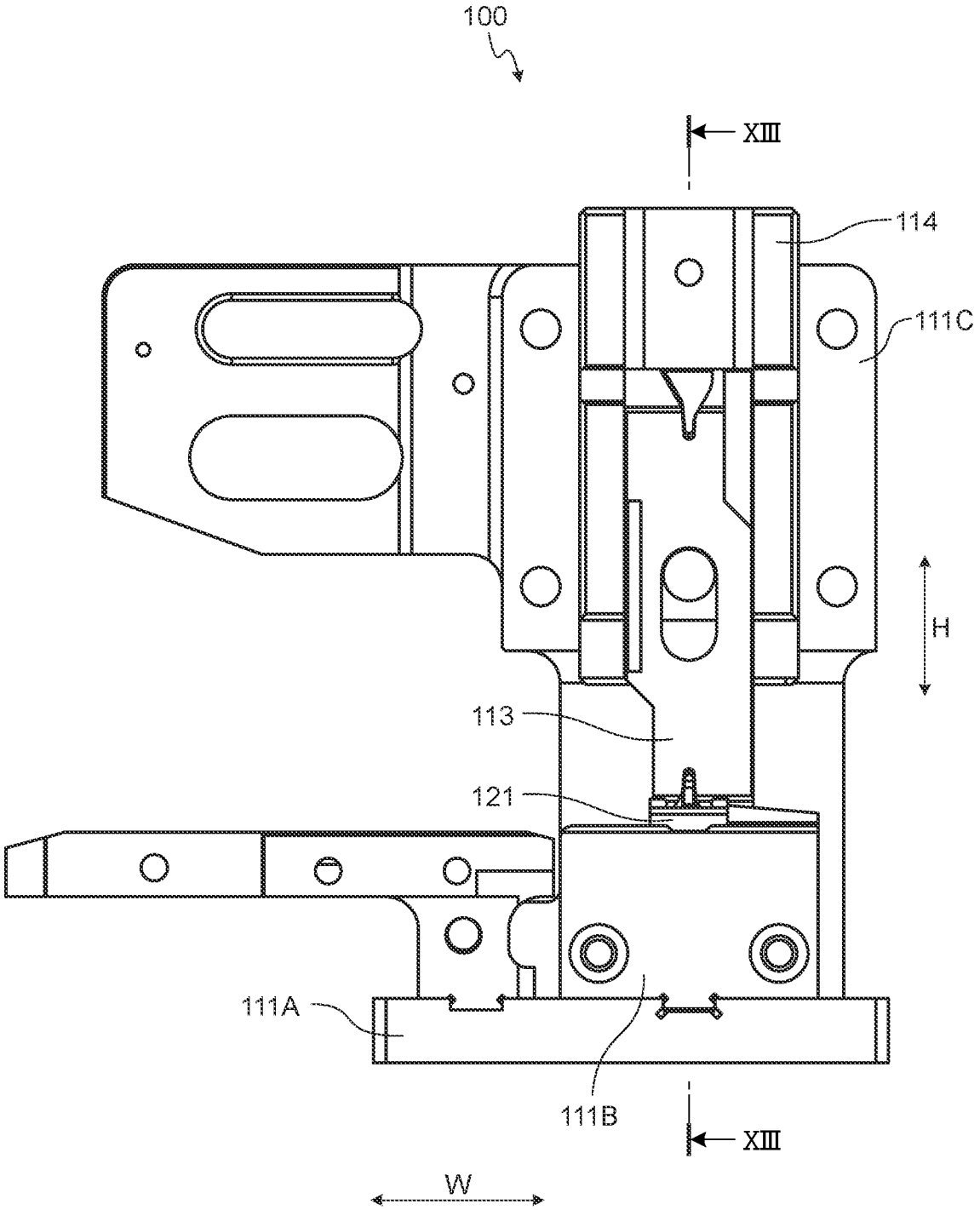
FIG. 9 is a front view of the terminal crimping apparatus according to an embodiment.

As illustrated in FIG. 8, the terminal crimping apparatus 100 includes a terminal supply device 101, the crimping device 102, and a driving device 103. The terminal crimping apparatus 100 is an apparatus referred to as an applicator in this technical field. The terminal supply device 101 is a device that supplies the crimping terminal 1 to a predetermined crimping position. The crimping device 102 is a device that crimps the crimping terminal 1 onto the wire 50 at the predetermined crimping position. The driving device 103 is a device that operates the terminal supply device 101 and the crimping device 102.

The terminal supply device 101 pulls out the terminal chain member 30 winded up in a reel shape, sequentially from the outer peripheral side. The terminal supply device 101 supplies the crimping terminals 1 of the pulled-out terminal chain member 30 to crimping positions, sequentially from the forefront side. When the forefront crimping terminal 1 is crimped onto the wire 50, and cut off from the joint piece 31, the terminal supply device 101 supplies the crimping terminal 1 that newly comes at the forefront, to the crimping position. Each time the crimping process and the terminal cutting process of one crimping terminal 1 are completed, the terminal supply device 101 performs a supply operation to supply the next crimping terminal 1 to the crimping position.

The terminal supply device 101 includes a terminal feed member 101*a* and a power transmission mechanism 101*b*. The terminal feed member 101*a* includes a protruding portion to be inserted into the terminal feed hole 31*a* of the joint piece 31. The terminal feed member 101*a* moves the terminal chain member 30 in the feed direction in a state in which the protruding portion is inserted into the terminal feed hole 31*a*. The power transmission mechanism 101*b* operates the terminal feed member 101*a* in conjunction with a crimping operation performed by the crimping device 102 (up-and-down movement of a ram 114A or the like that is to be described later). The terminal supply device 101 supplies the crimping terminal 1 to the crimping position by moving the terminal feed member 101*a* in the up-down direction and the feed direction in conjunction with the crimping operation of the crimping device 102.

The crimping device 102 executes the crimping process of crimping the supplied the crimping terminal 1 onto the wire 50, and a cutting process of cutting off the crimping terminal 1 from the joint piece 31. The crimping device 102 includes a crimping machine 110 and a terminal cutting mechanism 120.

The crimping machine 110 is a device that crimps the crimping terminal 1 onto the wire 50 by swaging the crimping terminal 1 to the end portion of the wire 50. The crimping machine 110 of the present embodiment crimps the crimping terminal 1 onto the wire 50 by swaging the first barrel piece portion 15 and the second barrel piece portion 16 of the crimping terminal 1 so as be winded around the core wire 51 and the covering 52 of the wire 50. The crimping machine 110 includes a frame 111, a first mold 112, a second mold 113, and a power transmission mechanism 114.

The frame 111 includes a base 111A, an anvil supporting member 111B, a transmission portion supporting member 111C, and a support base 111D. The base 111A is a member serving as a basis of the terminal crimping apparatus 100. The base 111A is fixed to a placement base on which the terminal crimping apparatus 100 is to be placed. The anvil supporting member 111B, the transmission portion supporting member 111C, and the support base 111D are fixed onto the base 111A.

The transmission portion supporting member 111C is disposed on the rear side (right side on a paper surface in FIG. 8) and on the upper side (upper side on the paper surface in FIG. 8) of the anvil supporting member 111B.

More specifically, the transmission portion supporting member 111C includes a standing portion 111$C_1$ and a ram supporting portion 111$C_2$. The standing portion 111$C_1$ is disposed on the rear side of the anvil supporting member 111B, and is vertically standing upward from the base 111A. The ram supporting portion 111$C_2$ is held on the upper side of the standing portion 111$C_1$. The ram supporting portion 111$C_2$ is a supporting portion that supports the ram 114A to be described later. The ram supporting portion 111$C_2$ is disposed on the upper side of the anvil supporting member 111B, at a predetermined interval from the anvil supporting member 111B. The support base 111D is a base that supports the terminal connection portion 11 of the crimping terminal 1. A height position of the top surface of the support base 111D is a position substantially similar to a height position of the top surface of the first mold 112.

Figure 10:
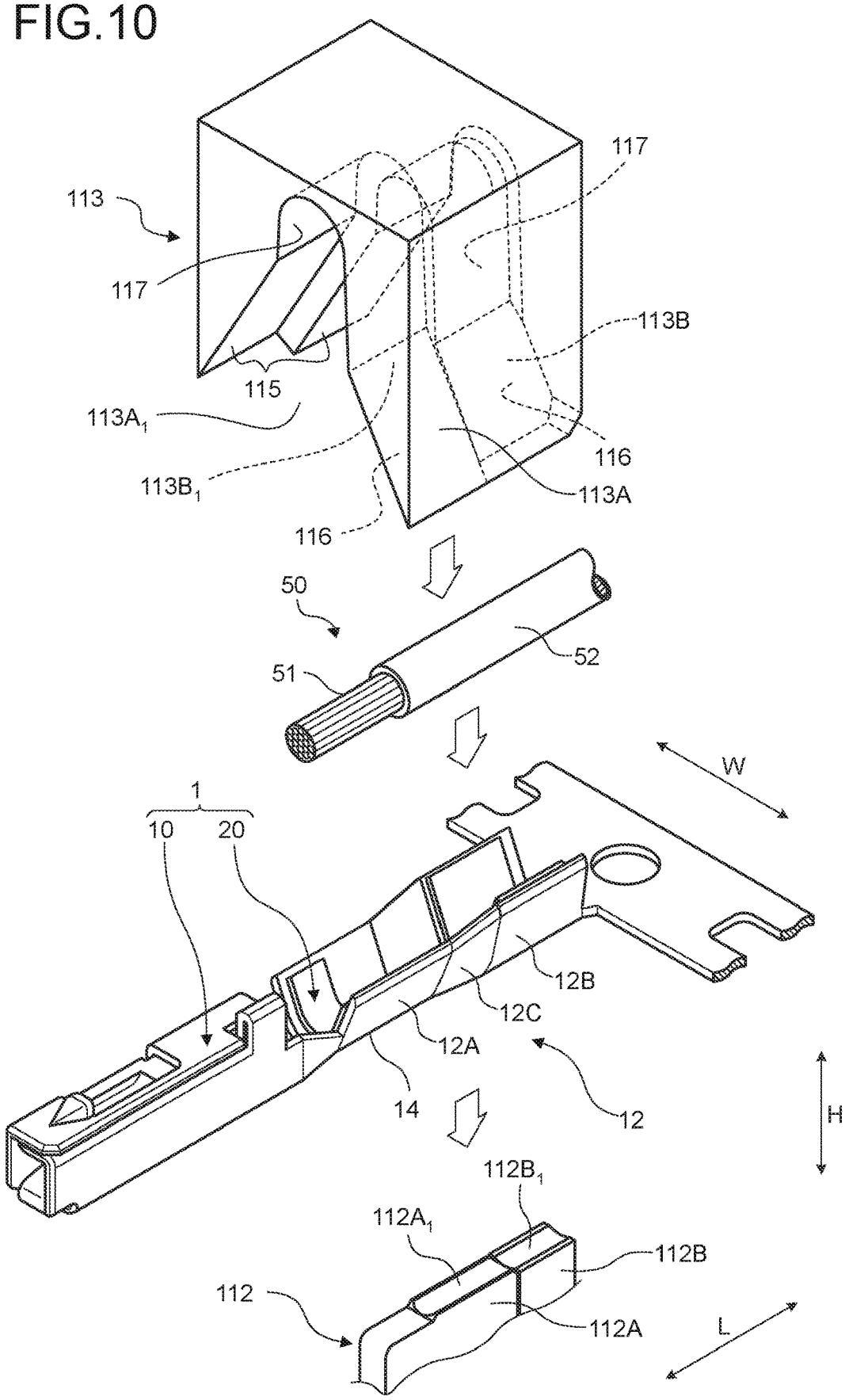
FIG. 10 is a perspective view illustrating first and second molds according to an embodiment.

The first mold 112 and the second mold 113 form a pair. The first mold 112 and the second mold 113 are disposed at an interval in the up-down direction. As illustrated in FIG. 10, the first mold 112 and the second mold 113 crimp the crimping terminal 1 onto the wire 50 by sandwiching the crimping terminal 1 and the wire 50 therebetween. The first mold 112 is a mold that supports the crimping terminal 1 from the lower side. The first mold 112 is formed of two lower molds, and includes a first anvil 112A serving as a first lower mold, and a second anvil 112B serving as a second lower mold. For example, the first anvil 112A and the second anvil 112B are integrally formed. The second mold 113 is disposed on the upper side of the first mold 112. The second mold 113 is formed of two upper molds, and includes a first crimper 113A serving as a first upper mold, and a second crimper 113B serving as a second upper mold.

The first anvil 112A and the first crimper 113A face each other in the up-down direction. The first anvil 112A and the first crimper 113A crimp the core wire crimping portion 12A. More specifically, the first anvil 112A and the first crimper 113A wind the U-shaped core wire crimping portion 12A around the core wire 51 of the wire 50 to crimp the core wire crimping portion 12A onto the core wire 51, by narrowing a distance therebetween.

The second anvil 112B and the second crimper 113B face each other in the up-down direction. The second anvil 112B and the second crimper 113B crimp the covering crimping portion 12B. More specifically, the second anvil 112B and the second crimper 113B wind the U-shaped covering crimping portion 12B around the covering 52 to crimp the covering crimping portion 12B onto the covering 52, by narrowing a distance therebetween.

In the crimping process, by transmitting power to the power transmission mechanism 114, the driving device 103 narrows a distance between the first mold 112 and the second mold 113 to crimp the wire connection portion 12 onto the wire 50. On the other hand, when the crimping process is completed, the driving device 103 widens the distance between the first mold 112 and the second mold 113. In the crimping device 102 of the present embodiment, a distance between the pair of molds 112 and 113 changes by the second mold 113 moving up and down with respect to the first mold 112. In the crimping device 102 of the present embodiment, after a crimping operation of the core wire crimping portion 12A that is performed by the first anvil 112A and the first crimper 113A is started, a crimping operation of the covering crimping portion 12B that is performed by the second anvil 112B and the second crimper 113B is started.

In addition, in the first mold 112, the first anvil 112A and the second anvil 112B may be separately formed, and in the second mold 113, the first crimper 113A and the second crimper 113B may be separately formed. In this case, the driving device 103 and the power transmission mechanism 114 may be configured to separately move the first crimper 113A and the second crimper 113B up and down.

The power transmission mechanism 114 transmits power output from the driving device 103, to the first crimper 113A and the second crimper 113B. As illustrated in FIG. 8, the power transmission mechanism 114 includes the ram 114A, a ram bolt 114B, and a shank 114C.

The ram 114A is a movable member supported so as to be movable up and down with respect to the ram supporting portion 111$C_2$. The second mold 113 is fixed to the ram 114A. Thus, the first crimper 113A and the second crimper 113B move up and down integrally with the ram 114A, with respect to the ram supporting portion 111$C_2$. For example, the shape of the ram 114A is a parallelepiped. A female screw portion (not illustrated) is formed in the ram 114A. The female screw portion is formed on the inner circumferential surface of a hole in the up-down direction that is formed from an inner side of the ram 114A toward an upper end surface.

The ram bolt 114B includes a male screw portion (not illustrated), and the male screw portion is screwed with the female screw portion of the ram 114A. Thus, the ram bolt 114B moves up and down integrally with the ram 114A, with respect to the ram supporting portion 111$C_2$. In addition, the ram bolt 114B includes a bolt head portion 114$B_1$ disposed on the upper side of the male screw portion. A female screw portion (not illustrated) is formed in the bolt head portion 114$B_1$. The female screw portion of the bolt head portion 114$B_1$ is formed on the inner circumferential surface of a hole in the up-down direction that is formed from an inner side of the bolt head portion 114$B_1$ toward an upper end surface.

The shank 114C is a cylindrically-shaped hollow member, and includes a male screw portion 114$C_1$ and a connection portion (not illustrated) at each end portion. The male screw portion 114$C_1$ of the shank 114C is formed on the lower side of the hollow member, and is screwed with the female screw portion of the bolt head portion 114$B_1$ of the ram bolt 114B. Thus, the shank 114C moves up and down integrally with the ram 114A and the ram bolt 114B, with respect to the ram supporting portion 111$C_2$. The connection portion of the shank 114C is connected to the driving device 103.

The driving device 103 includes a driving source (not illustrated), and a power conversion mechanism (not illustrated) that converts drive power of the driving source into power in the up-down direction. The connection portion of the shank 114C is joined to an output shaft of the power conversion mechanism. Thus, the first crimper 113A and the second crimper 113B move up and down integrally with the ram 114A, the ram bolt 114B, and the shank 114C, with respect to the ram supporting portion 111$C_2$, according to an output of the driving device 103 (output of the power conversion mechanism). As the driving source of the driving device 103, an electrical actuator of an electrical motor or the like, a hydraulic actuator of a hydraulic cylinder or the like, an air pressure actuator of an air cylinder or the like, and the like can be applied.

A relative position in the up-down direction of the first crimper 113A with respect to the first anvil 112A, and a relative position in the up-down direction of the second crimper 113B with respect to the second anvil 112B can be changed by adjusting a screw amount of the female screw portion of the bolt head portion 114$B_1$ and the male screw portion 114$C_1$ of the shank 114C. A nut 114D is screwed with the male screw portion 114$C_1$ of the shank 114C on the upper side of the ram bolt 114B. Thus, the nut 114D functions as a so-called locknut together with the female screw portion of the bolt head portion 114$B_1$. By being tightened toward the ram bolt 114B side after the completion of the adjustment of the above-described relative positions, the nut 114D can fix the first crimper 113A and the second crimper 113B at the relative positions.

As illustrated in FIG. 10, recessed surfaces 112$A_1$ and 112$B_1$ recessed downward are formed at the respective upper distal ends of the first anvil 112A and the second anvil 112B. The respective recessed surfaces 112$A_1$ and 112$B_1$ are formed so as to have arc-shaped cross sections, in accordance with the respective shapes of the bottom portion 14 of the U-shaped core wire crimping portion 12A and the U-shaped covering crimping portion 12B. In the crimping machine 110, the recessed surfaces 112$A_1$ and 112$B_1$ each serve as a crimping position. In the crimping terminal 1 supplied with the bottom portion 14 facing downward, the bottom portion 14 of the core wire crimping portion 12A is placed on the recessed surface 112$A_1$ of the first anvil 112A, and the bottom portion 14 of the covering crimping portion 12B is placed on the recessed surface 112$B_1$ of the second anvil 112B. The first mold 112 is supported by the anvil supporting member 111B in a state in which the recessed surfaces 112$A_1$ and 112$B_1$ are exposed upward.

As illustrated in FIG. 10, recessed portions 113$A_1$ and 113$B_1$ recessed upward are respectively formed in the first crimper 113A and the second crimper 113B. The recessed portions 113$A_1$ and 113$B_1$ are disposed to face the respective recessed surfaces 112$A_1$ and 112$B_1$ of the first anvil 112A and the second anvil 112B in the up-down direction. Each of the recessed portions 113$A_1$ and 113$B_1$ includes first and second wall surfaces 115 and 116, and a third wall surface 117. The first wall surface 115 and the second wall surface 116 face each other in the second direction W. The third wall surface 117 links the upper ends of the first and second wall surfaces 115 and 116. While bringing the first to third wall surface 115, 116, and 117 into contact with the first barrel piece portion 15 and the second barrel piece portion 16, each of the recessed portions 113$A_1$ and 113$B_1$ winds the first barrel piece portion 15 and the second barrel piece portion 16 around the end portion of the wire 50 to swage thereonto. Each of the recessed portions 113$A_1$ and 113$B_1$ is formed so as to be able to perform such a swaging operation.

The crimping terminal 1 having been subjected to the crimping processing in the crimping machine 110 is cut off from the joint piece 31 by the terminal cutting mechanism 120. The terminal cutting mechanism 120 cuts the link portion 32 of the crimping terminal 1 supplied to the crimping position by sandwiching the link portion 32 between two terminal cutting portions, and performs the cut off in conjunction with the progress of the crimping process. As illustrated in FIG. 8, the terminal cutting mechanism 120 is disposed on the front side (the left side in on the paper surface in FIG. 8) of the second anvil 112B. The terminal cutting mechanism 120 includes a terminal cutting member 121, a pressing member 122, and an elastic member 123.

Figure 11:
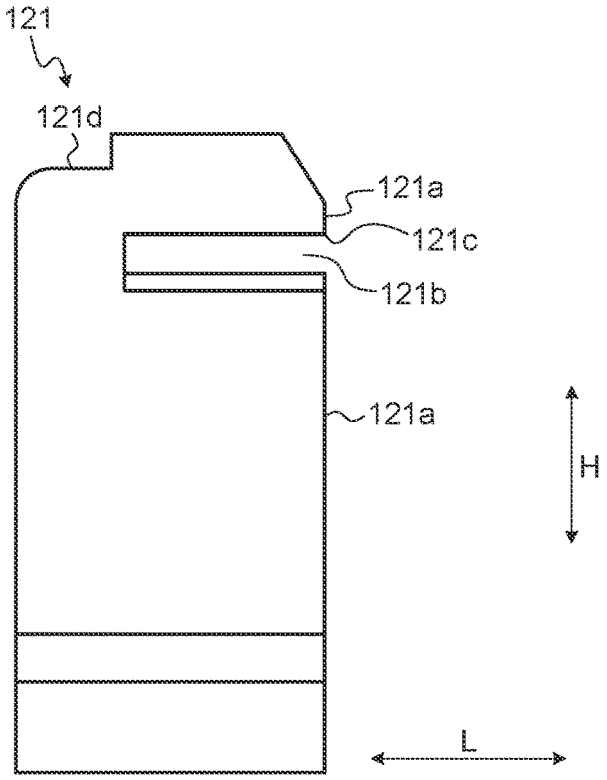
FIG. 11 is a side view illustrating a terminal cutting member according to an embodiment.

The terminal cutting member 121 is formed into a parallelepiped, and is disposed so as to be slidable in the up-down direction along the front surface of the second anvil 112B. As illustrated in FIGS. 11 and 12, a slit 121*b* is formed in the terminal cutting member 121 from a sliding contact surface 121*a* with the second anvil 112B toward the inside. The slit 121*b* is a pathway of the joint piece 31 of the terminal chain member 30. When the crimping target the crimping terminal 1 is supplied to the crimping position, part of the link portion 32 linking to the crimping terminal 1 protrudes from the slit 121*b*. The crimping terminal 1 supplied to the crimping position is supported by the first mold 112 from the lower side.

The terminal cutting member 121 cuts the link portion 32 while relatively moving up and down with respect to the first mold 112 and the crimping terminal 1. Here, a position at which the joint piece 31 and the like can be inserted into the slit 121*b* is assumed to be a default position in the up-down direction of the terminal cutting member 121. As illustrated in FIG. 13, an end portion on the wire connection portion 12 side of the link portion 32 protrudes from the slit 121*b* via an opening on the sliding contact surface 121*a* side (i.e., the crimping terminal 1 side) of the slit 121*b*. In the terminal cutting member 121, an edge portion (hereinafter, referred to as an "opening edge") 121*c* on the upper side in the opening is used as one terminal cutting portion. The other terminal cutting portion is a top surface edge 112*a* of the second anvil 112B.

The pressing member 122 is fixed to the ram 114A, and moves up and down integrally with the ram 114A. The pressing member 122 is disposed on the upper side of the terminal cutting member 121, and presses down the terminal cutting member 121 by lowering. The pressing member 122 is formed into a parallelepiped. The elastic member 123 is a member that adds upper biasing force to the terminal cutting member 121, and is formed of a spring member or the like. The elastic member 123 returns the terminal cutting member 121 to the default position in the up-down direction when pressing force applied from the pressing member 122 is released.

In the terminal cutting mechanism 120, the pressing member 122 lowers together with the lowering of the second mold 113 in the crimping processing, to press down the terminal cutting member 121. By the terminal cutting member 121 lowering, the link portion 32 is sandwiched between the opening edge 121*c* of the slit 121*b* and the top surface edge 112*a* (FIG. 13) of the second anvil 112B. In the terminal cutting mechanism 120, the opening edge 121*c* and the top surface edge 112*a* function as scissors, and add shearing force to the link portion 32. By the terminal cutting member 121 being further pressed down, the opening edge 121*c* and the top surface edge 112*a* cut the link portion 32, and cut off the crimping terminal 1 from the joint piece 31. In addition, for enhancing cutting performance, the opening edge 121*c* is inclined on the sliding contact surface 121*a* with respect to the top surface edge 112*a*.

As illustrated in FIG. 13, the crimping target the wire 50 is disposed at a predetermined position located between the terminal cutting member 121 and the pressing member 122. More specifically, the wire 50 is placed on a top surface 121*d* of the terminal cutting member 121. Thus, a space for letting the wire 50 escape is provided in at least one of an upper portion of the terminal cutting member 121 and a lower portion of the pressing member 122 so that the wire 50 is not squished therebetween.

Here, the predetermined position is a position at which the end portion of the wire 50 not having been subjected to the crimping processing exists on the upper side of the bottom portion 14 of the flat-plate-shaped wire connection portion 12. In addition, the predetermined position is a position at which the core wire 51 can be placed on the bottom portion 14 of the core wire crimping portion 12A so that the distal end of the core wire 51 that has been pressed down at the start of the crimping processing does not protrude from the core wire crimping portion 12A. The core wire 51 extends in an axis line direction in accordance with the crimping processing, and a distal end position of the core wire 51 sometimes moves in the axis line direction. The predetermined position is desirably determined in consideration of the extension.

On the other hand, the end portion (the core wire 51 at the distal end and the covering 52) of the wire 50 is pressed down by the second mold 113 toward the inner wall surface side of the wire connection portion 12. Thus, if no holding is provided, the wire 50 is uplifted from the top surface 121*d* of the terminal cutting member 121, and the core wire 51 at the distal end and the covering 52 may be crimped in a state of not being placed on the bottom portion 14 of the wire connection portion 12. Thus, the terminal crimping apparatus 100 of the present embodiment is provided with a wire holding mechanism that holds the wire 50 at the predetermined position between itself and the upper portion of the terminal cutting member 121, and suppresses a position shift of the end portion of the wire 50 with respect to the wire connection portion 12 that occurs in the crimping processing.

The wire holding mechanism includes a wire retaining member 118 (FIG. 13) that retains the wire 50 placed on the top surface 121*d* of the terminal cutting member 121 that serves as a wire placement portion, by pressing the wire 50 against the top surface 121*d*. The wire retaining member 118 is disposed on the upper side of the terminal cutting member 121, and between the second mold 113 and the pressing member 122. A space (hereinafter, referred to as a "wire holding space") 118A for holding the covering 52 of the wire 50 is formed between the top surface 121*d* of the terminal cutting member 121 and the bottom surface of the wire retaining member 118. The wire holding space 118A suppresses the uplift of the wire 50 from the top surface 121*d* of the terminal cutting member 121 that occurs in the crimping process, and suppresses a position shift of the core wire 51 at the distal end and the covering 52 with respect to the wire connection portion 12. The wire retaining member 118 is a member that can move up and down with respect to the top surface 121*d* of the terminal cutting member 121, and forms the wire holding space 118A between itself and the upper portion of the terminal cutting member 121 by lowering. For example, the wire retaining member 118 is fixed to the ram 114A, and moves up and down integrally with the ram 114A. The wire 50 is held in the wire holding space 118A formed in accordance with the lowering of the wire retaining member 118.

Figure 19:
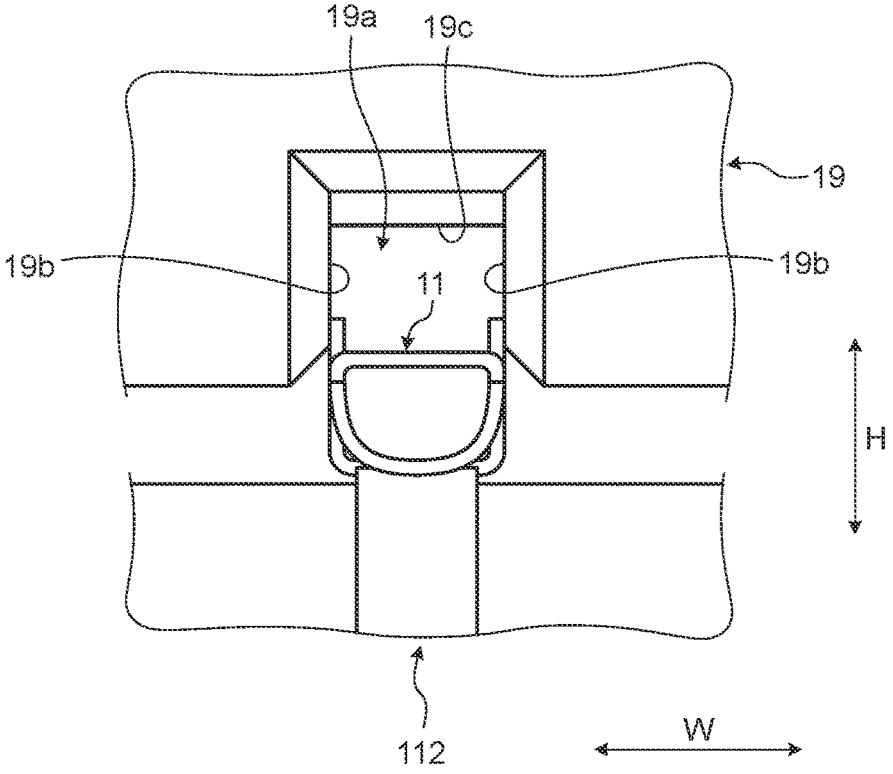
FIG. 19 is a diagram illustrating a supporting stopper of an embodiment.

The crimping machine 110 of the present embodiment includes a supporting stopper 19 and a regulation portion 40. The supporting stopper 19 supports the terminal connection portion 11 of the crimping terminal 1 in the crimping process. The supporting stopper 19 is disposed at a position facing the terminal connection portion 11 in the third direction H. The supporting stopper 19 is a member being supported by the ram 114A, and moving integrally with the ram 114A. The supporting stopper 19 lowers in conjunction with the lowering of the ram 114A, to cover the terminal connection portion 11 from the upper side. As illustrated in FIG. 19, the supporting stopper 19 includes a groove-shaped recessed portion 19*a* corresponding to the terminal connection portion 11. The recessed portion 19*a* is formed to have an oblong cross-sectional shape, and extends in the longitudinal direction of the terminal connection portion 11, that is, in the first direction L. The width of the recessed portion 19*a* of the present embodiment is set to be slightly wider than the width of the terminal connection portion 11.

If the supporting stopper 19 lowers, the recessed portion 19*a* covers the terminal connection portion 11. The supporting stopper 19 supports the terminal connection portion 11 from the both sides in the second direction W using side surfaces 19*b* and 19*b* of the recessed portion 19*a*. The side surfaces 19*b* and 19*b* respectively face side surfaces on the both sides of the terminal connection portion 11. If the terminal connection portion 11 is likely to move or deform in the crimping process, the side surfaces 19*b* and 19*b* suppress the movement and the deformation. A bottom surface 19*c* of the supporting stopper 19 faces the terminal connection portion 11 in the third direction H. The supporting stopper 19 holds the terminal connection portion 11 by the bottom surface 19*c* of the recessed portion 19*a* coming into contact with the terminal connection portion 11. The bottom surface 19*c* suppresses the movement and the deformation of the terminal connection portion 11. In this manner, the supporting stopper 19 suppresses the movement and the deformation of the terminal connection portion 11 in the crimping process.

As illustrated in FIG. 13, the regulation portion 40 is disposed between the second mold 113 and a supporting stopper 19. The regulation portion 40 of the present embodiment is fixed to the ram 114A, and moves up and down integrally with the ram 114A and the second mold 113. As described below, the regulation portion 40 supports the joint portion 13 from the side in the crimping process, to suppress the deformation of the joint portion 13.

Figure 14:
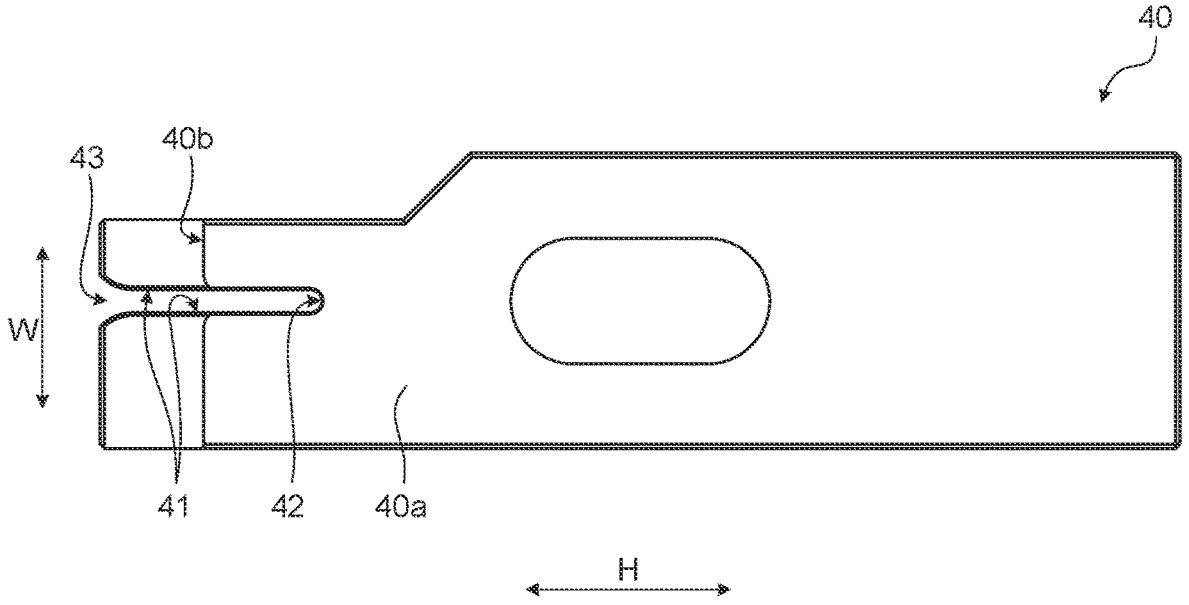
FIG. 14 is a side view of a regulation portion according to an embodiment.
Figure 15:
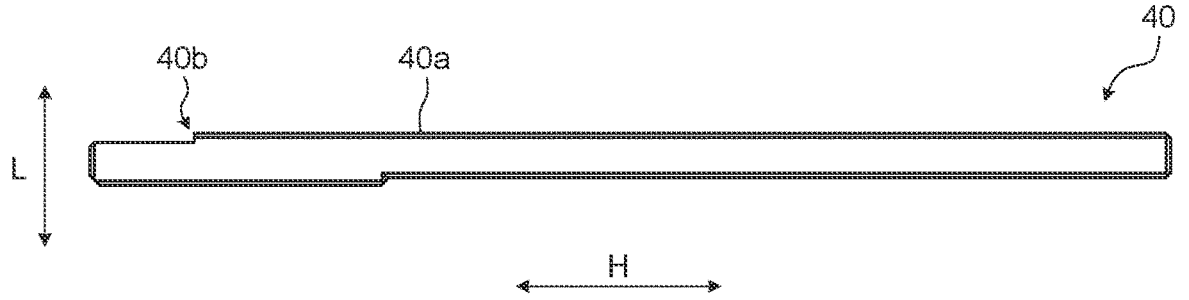
FIG. 15 is a front view of the regulation portion according to an embodiment.
Figure 16:
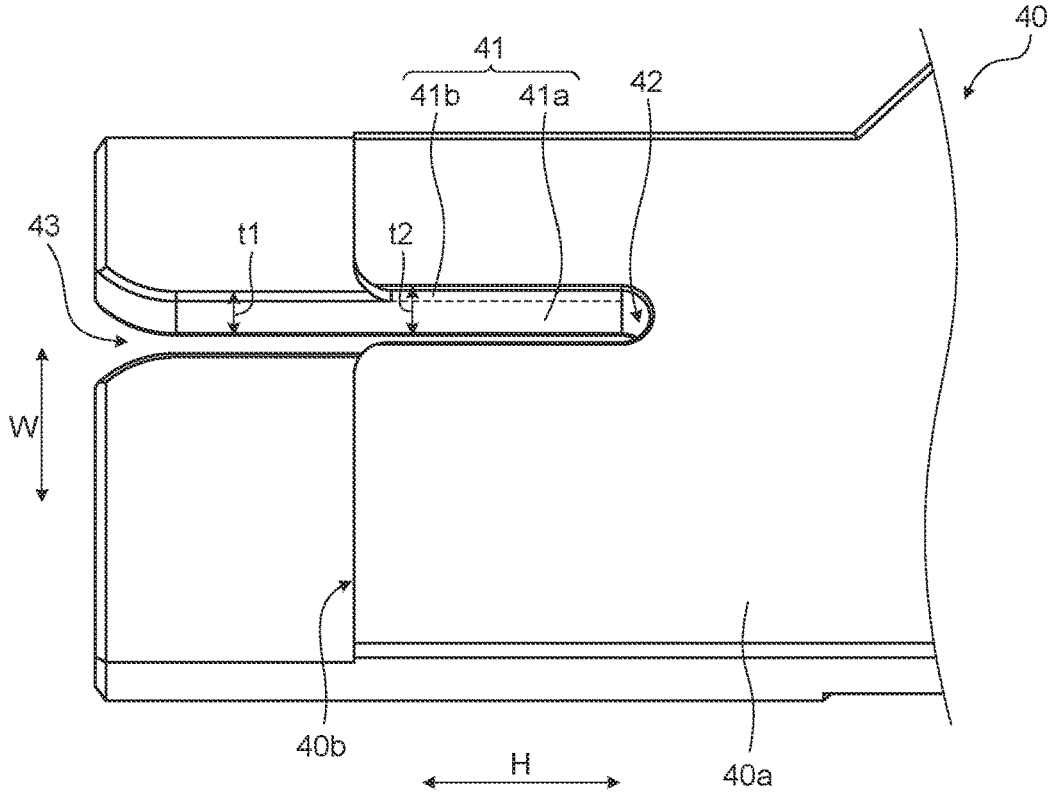
FIG. 16 is a perspective view of the regulation portion according to an embodiment.

As illustrated in FIGS. 14 to 16, the regulation portion 40 is a plate-shaped member. The regulation portion 40 is a substantially-rectangular member having a total length in the third direction H being longer than a total length in the second direction W. A slit-shaped recessed portion 43 is provided at one end in the longitudinal direction of the regulation portion 40. A length in depth of the recessed portion 43 is defined according to a stroke in the up-down direction of the regulation portion 40 in the crimping process. The regulation portion 40 includes a pair of wall surfaces 41 and 41 sandwiching the recessed portion 43, and a rear portion wall surface 42. The pair of wall surfaces 41 and 41 face each other in the second direction W. The rear portion wall surface 42 links end portions of the pair of wall surfaces 41 and 41. For example, the shape of the rear portion wall surface 42 is an arc shape as illustrated in FIG. 14.

As illustrated in FIG. 16, each of the wall surfaces 41 includes a first region 41*a* and a second region 41*b*. The first region 41*a* is a region supporting the terminal connection portion 11 of the crimping terminal 1 from the side. The second region 41*b* is a region supporting the joint portion 13 of the crimping terminal 1 from the side. The first region 41*a* is a region positioned on one side in a plate thickness direction of the regulation portion 40, and the second region 41*b* is a region positioned on the other side in the plate thickness direction of the regulation portion 40. The first region 41*a* protrudes in the longitudinal direction of the regulation portion 40 more than the second region 41*b*. Thus, the shape of the regulation portion 40 is a shape with a level difference in which a plate thickness t1 on a distal end side is thinner than a plate thickness t2 of a portion in which the second region 41*b* exists. According to the difference between the plate thicknesses t1 and t2, a level difference 40*b* is provided on a surface 40*a* of the regulation portion 40. In addition, the surface 40*a* is a surface facing the second mold 113. In addition, an interval between the pair of wall surfaces 41 and 41 is assumed to remain constant in the third direction H. Nevertheless, the shape of distal end portions of the first region 41*a* and the second region 41*b* is assumed to be an attracting shape in which an interval becomes wider toward the distal end.

Figure 17:
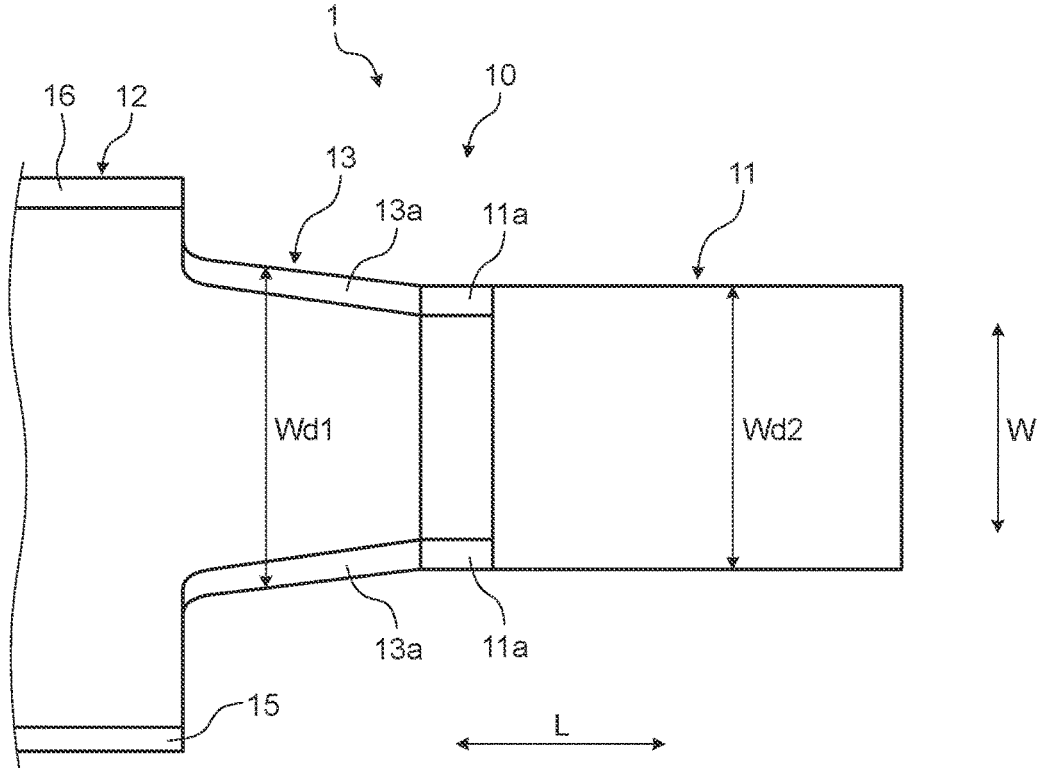
FIG. 17 is a plan view illustrating a joint portion of the crimping terminal according to an embodiment.

In the present embodiment, in the crimping terminal 1 not being crimped, as illustrated in FIG. 17, a width Wd1 of the joint portion 13 is wider than a width Wd2 of the terminal connection portion 11. The width Wd1 of the joint portion 13 becomes wider from the terminal connection portion 11 toward the wire connection portion 12.

Figure 18:
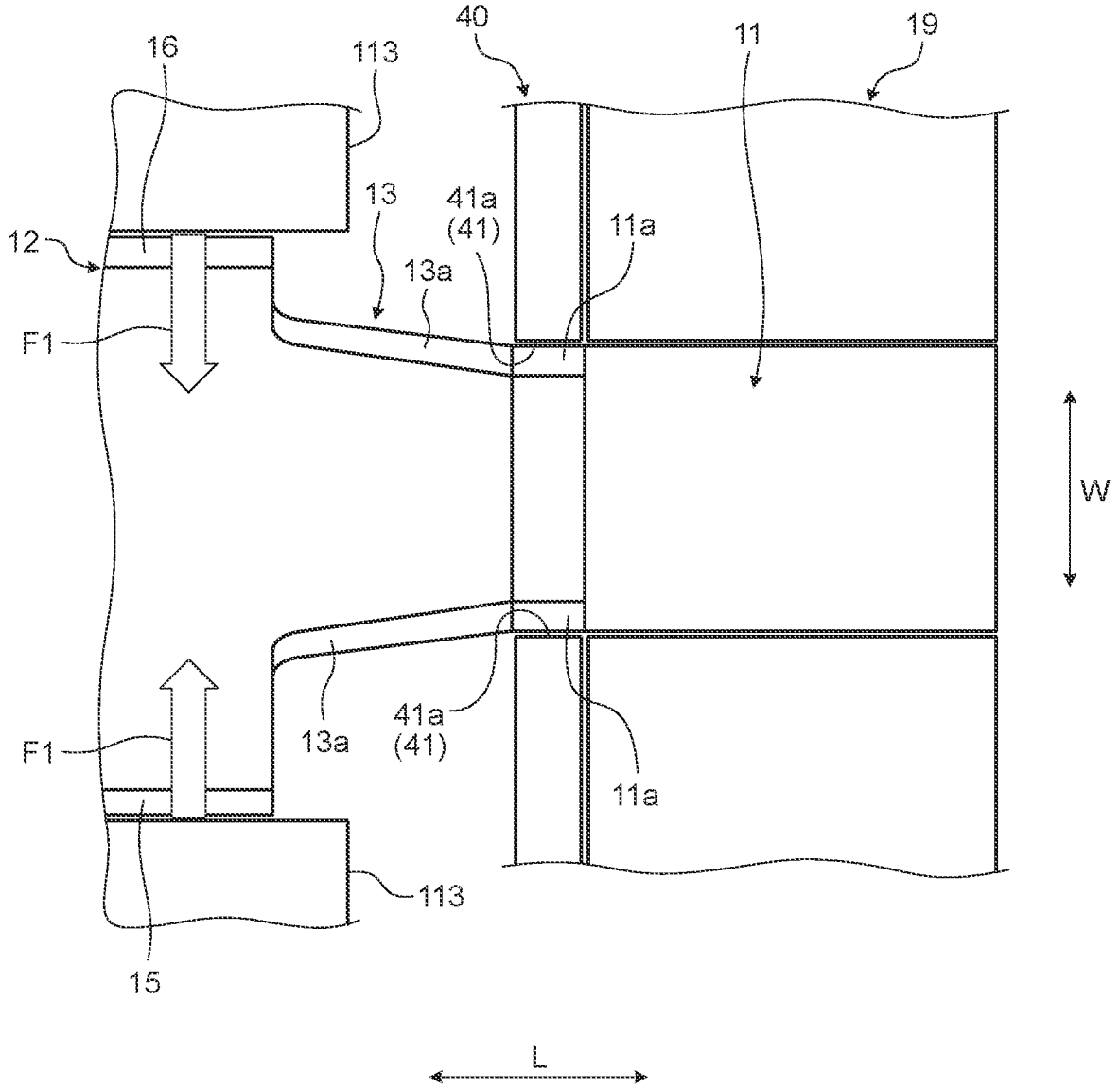
FIG. 18 is a plan view illustrating an initial stage of a crimping process performed by the terminal crimping apparatus according to an embodiment.

FIG. 18 illustrates a state at an initial stage of the crimping process. As illustrated in FIG. 18, the second mold 113 presses the barrel piece portions 15 and 16 of the wire connection portion 12 from the both sides in the second direction W, and deforms the barrel piece portions 15 and 16 so as to narrow an interval therebetween. At this time, the first regions 41*a* of the regulation portion 40 face the terminal connection portion 11. More specifically, the pair of wall surfaces 41 and 41 of the regulation portion 40 lowering together with the second mold 113 start to face side surfaces of the terminal connection portion 11 at the initial stage of the crimping process. A timing at which a pair of wall surfaces 41 and 41 start to face the terminal connection portion 11 is earlier than a timing at which the supporting stopper 19 starts to face the side surfaces of the terminal connection portion 11. In other words, the regulation portion 40 starts to support the terminal connection portion 11 from the side earlier, and the supporting stopper 19 subsequently starts to support the terminal connection portion 11 from the side.

Together with the supporting stopper 19, the first regions 41*a* support the terminal connection portion 11 from the both sides in the second direction W. This suppresses a movement such as rolling and twist of the terminal connection portion 11. Here, the rolling refers to a movement of rotation around an axis extending in the first direction L, and the twist refers to a movement of inclining with respect to the first direction L.

Figure 20:
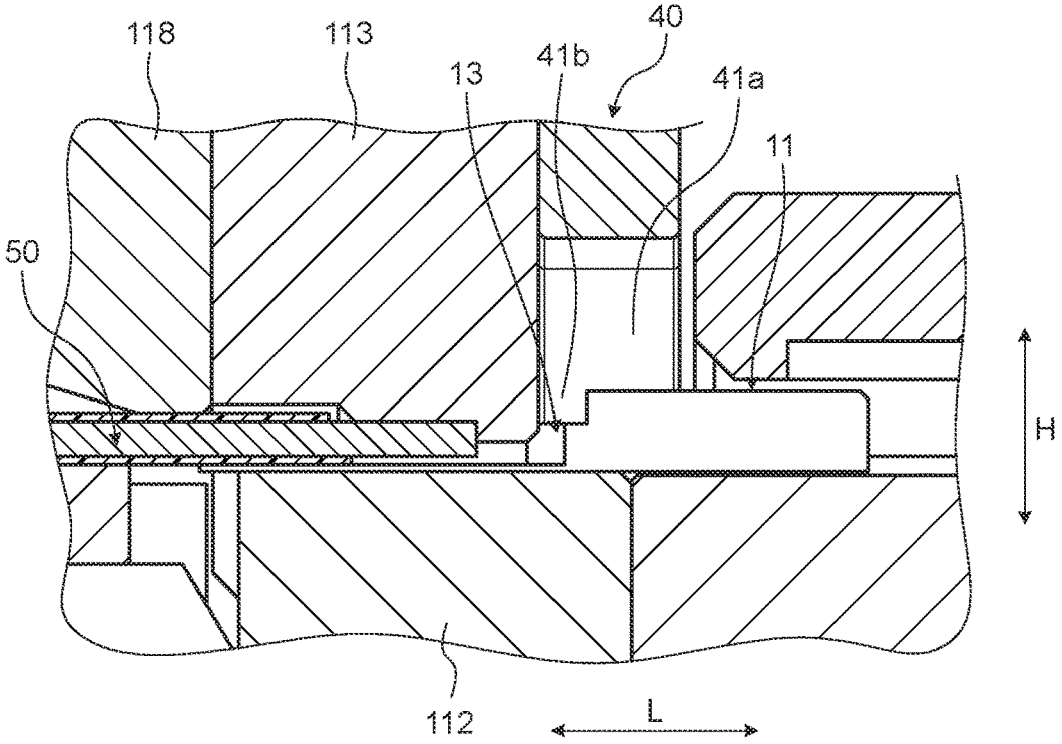
FIG. 20 is a cross-sectional view illustrating a completion time of the crimping process performed by the terminal crimping apparatus according to an embodiment.
Figure 21:
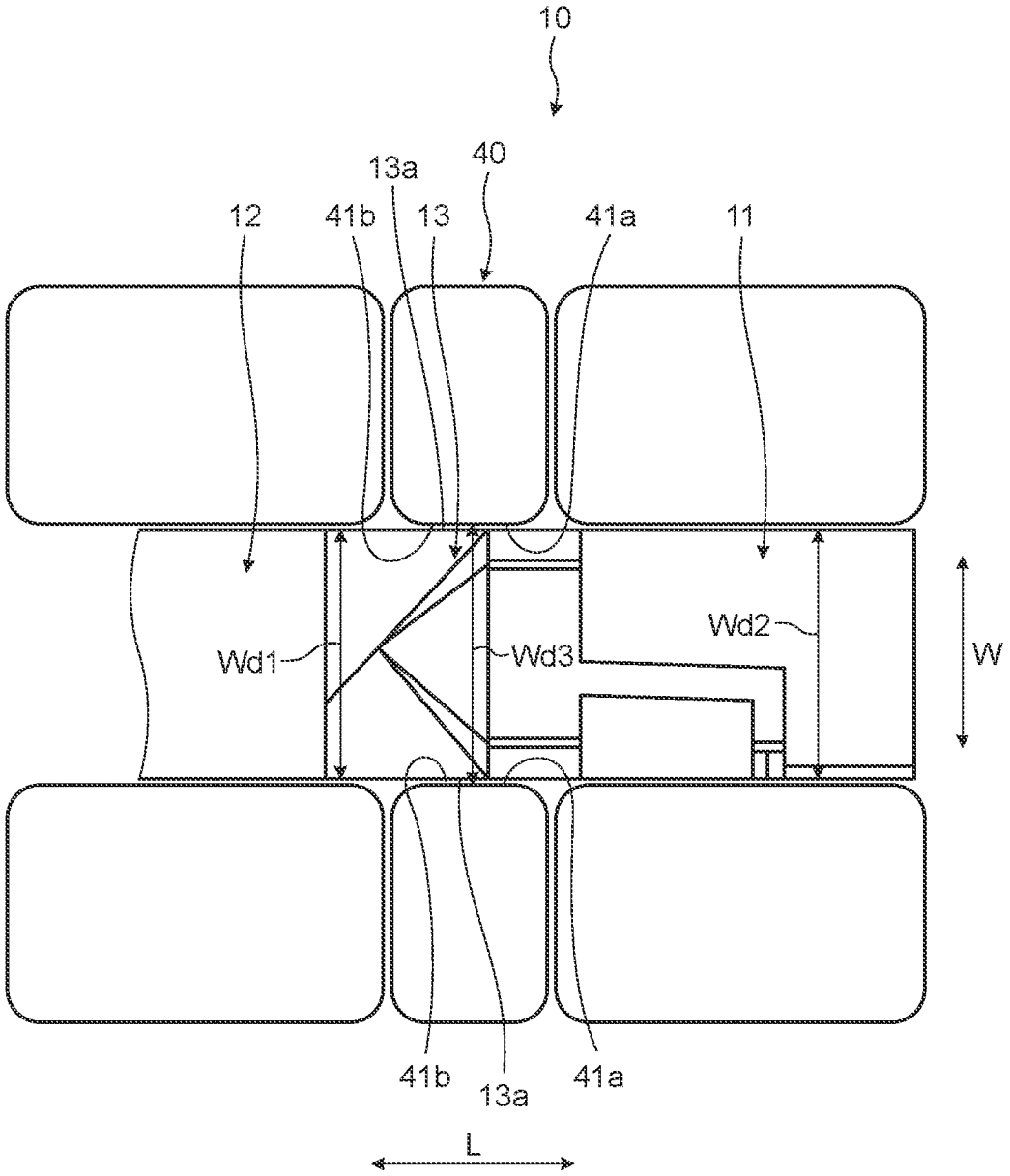
FIG. 21 is a plan view illustrating the completion time of the crimping process performed by the terminal crimping apparatus according to an embodiment.

By pressing force F1 applied from the second mold 113, the barrel piece portions 15 and 16 deform to be bent inward, and the joint portion 13 connecting to the barrel piece portions 15 and 16 also deforms inward. When the joint portion 13 starts to deform inward, the second regions 41*b* of the regulation portion 40 face the joint portion 13 as illustrated in FIGS. 20 and 21. As illustrated in FIG. 21, the second regions 41*b* support the joint portion 13 from the both sides in the second direction W. This suppresses the deformation of the joint portion 13. For example, as described below, outward swelling deformation of the joint portion 13 is suppressed.

When the second mold 113 presses the wire connection portion 12 against the first mold 112 to crimp the wire connection portion 12 onto the wire 50, the wire connection portion 12 tries to extend in the first direction L. Nevertheless, because the terminal connection portion 11 is held by the supporting stopper 19, the extension is suppressed. This applies force to the joint portion 13, and deformation such as outward curving may be generated in the joint portion 13. If the joint portion 13 is deformed to swell outward, when the crimping terminal 1 is accommodated into a cavity of a connector or the like, a deformed location of the joint portion 13 may damage the cavity.

In view of this, in the terminal crimping apparatus 100 of the present embodiment, the regulation portion 40 supports the joint portion 13 from the outside. The regulation portion 40 faces the side walls 13*a* of the joint portion 13 in the second direction W, and suppresses the deformation of the joint portion 13. The regulation portion 40 of the present embodiment regulates the width Wd1 of the joint portion 13 so as not to be wider than the width Wd2 of the terminal connection portion 11, by sandwiching the joint portion 13 from the both sides in the width direction in the crimping process. The regulation portion 40 regulates at least the width Wd1 of the joint portion 13 that is obtainable when the crimping process is completed, so as not to be wider than the width Wd2 of the terminal connection portion 11.

As a method of regulating the width Wd1 of the joint portion 13, the regulation portion 40 may press the side walls 13*a* of the joint portion 13 toward the inside in the width direction, using the pair of wall surfaces 41 and 41, and actively deform the joint portion 13. Alternatively, the regulation portion 40 may support the side walls 13*a* of the joint portion 13 that try to swell outward in the width direction, using the pair of wall surfaces 41 and 41, to prevent further deformation. These regulation modes may vary according to the way of deformation of each of the crimping terminals 1 in the crimping process. For example, when the joint portion 13 is deformed to swell outward before the regulation portion 40 starts to support, the regulation portion 40 can deform the joint portion 13 in a direction to restore the deformation to the original state.

As described above, the terminal crimping apparatus 100 according to the present embodiment includes the terminal supply device 101, the first mold 112, the second mold 113, and the regulation portion 40. The terminal supply device 101 supplies the crimping terminal 1 to a crimping position with the wire 50. The crimping terminal 1 to be supplied includes the terminal connection portion 11 to be electrically-connected to the counterpart terminal, the wire connection portion 12 to be crimped onto the wire 50, and the joint portion 13 linking side walls of the terminal connection portion 11 and the wire connection portion 12.

The first mold 112 supports the bottom portion 14 of the crimping terminal 1 supplied to the crimping position by the terminal supply device 101. While relatively moving toward the first mold 112, the second mold 113 deforms the wire connection portion 12, and crimps the wire connection portion 12 onto the wire 50. The regulation portion 40 regulates the width Wd1 of the joint portion 13 so as not to be wider than the width Wd2 of the terminal connection portion 11, by sandwiching the joint portion 13 from the both sides in the width direction when the second mold 113 crimps the wire connection portion 12. Thus, the terminal crimping apparatus 100 of the present embodiment can suppress deformation of the crimping terminal 1 in crimping. More specifically, by regulating the width Wd1 of the joint portion 13 so as not to be wider than the width Wd2 of the terminal connection portion 11, the terminal crimping apparatus 100 facilitates the attachment of the crimping terminal 1 with respect to a cavity of a connector or a cavity provided in a block or the like of an electrical connection box. In addition, possibility of damages to an inner wall of a cavity that are caused by the joint portion 13 when the joint portion 13 is accommodated into the cavity is reduced.

The regulation portion 40 of the present embodiment includes the pair of wall surfaces 41 and 41 that sandwich the joint portion 13 from the both sides in the width direction. A width Wd3 (refer to FIG. 21) of a clearance gap between the pair of wall surfaces 41 and 41 corresponds to the width Wd2 of the terminal connection portion 11. For example, the width Wd3 of the clearance gap is assumed to be a value equal to the width Wd2 of the terminal connection portion 11. In this case, the regulation portion 40 can set the width Wd1 of the joint portion 13 to a value equal to or smaller than the width Wd2 of the terminal connection portion 11. The width Wd3 of the clearance gap may be set to a value equal to or smaller than the width Wd2 of the terminal connection portion 11, or may be set to a value smaller than the width Wd2 of the terminal connection portion 11. In addition, when the width Wd2 of the terminal connection portion 11 varies depending on regions of the terminal connection portion 11, the width Wd3 of the clearance gap may be set with respect to the maximum value of the width Wd2 of the terminal connection portion 11.

The regulation portion 40 of the present embodiment includes the pair of wall surfaces 41 and 41 facing each other in the width direction of the crimping terminal 1. The pair of wall surfaces 41 and 41 includes the first regions 41*a* facing the side walls 11*a* of the terminal connection portion 11, and the second regions 41*b* facing the side walls 13*a* of the joint portion 13. When the regulation portion 40 lowers together with the second mold 113 in the crimping process, a timing at which the first regions 41*a* start to face the side walls 11*a* of the terminal connection portion 11 is earlier than a timing at which the second regions 41*b* start to face the side walls 13*a* of the joint portion 13. With this configuration, after the first regions 41*a* start to support the side walls 11*a* of the terminal connection portion 11, the second regions 41*b* start to support the side walls 13*a* of the joint portion 13. The second regions 41*b* start to support the side walls 13*a* at a timing at which the crimping process progresses and the side walls 13*a* of the joint portion 13 start to close. This suppresses interference between the lowering regulation portion 40 and end surfaces of the side walls 13*a* and damages to the side walls 13*a*. In addition, the regulation portion 40 supports both the terminal connection portion 11 and the joint portion 13 from the side. This suppresses deformation such as relative twist and bending of the terminal connection portion 11 and the joint portion 13.

In addition, the material of the core wire 51 of the wire 50 is not limited to aluminum. For example, the core wire 51 may be copper or copper alloy, or another conductive metal. The material of the crimping terminal 1 is not limited to copper and copper alloy, and may be another conductive metal.

First Modified Example of Embodiment

Figure 22:
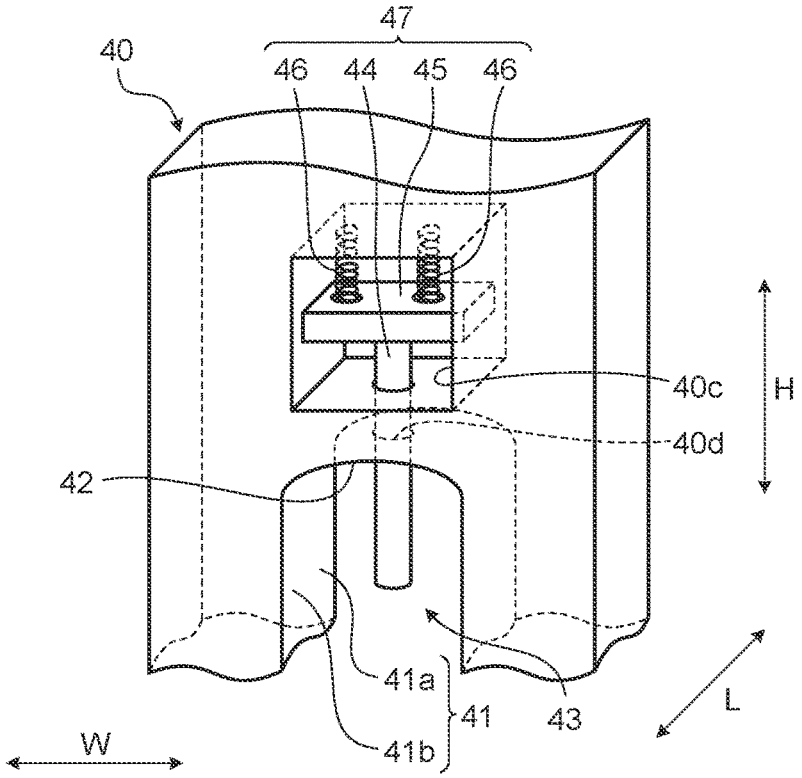
FIG. 22 is a perspective view of a regulation portion according to a first modified example of an embodiment.
Figure 23:
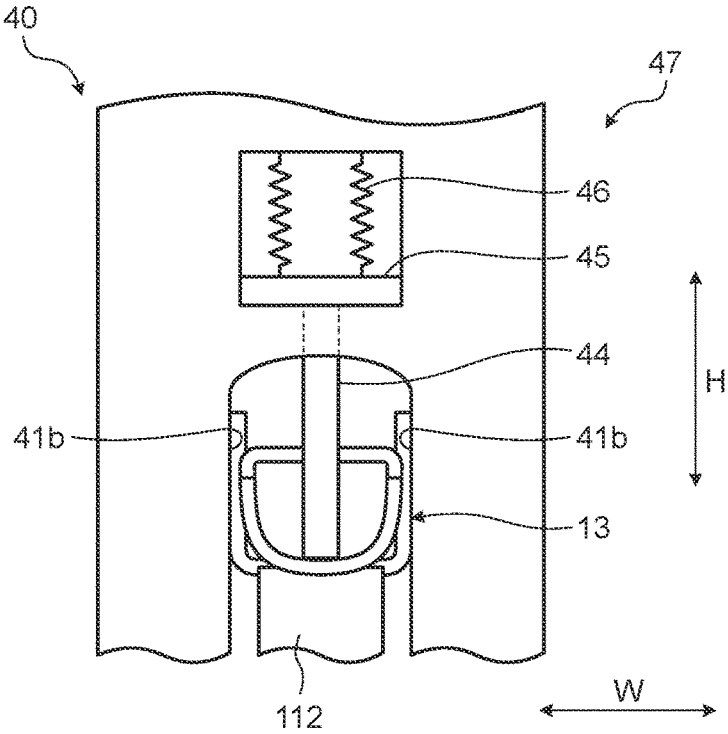
FIG. 23 is a diagram illustrating an operation of the regulation portion according to the first modified example of an embodiment.

A first modified example of the embodiment will be described. FIG. 22 is a perspective view of a regulation portion according to the first modified example of the embodiment, and FIG. 23 is a diagram illustrating an operation of the regulation portion according to the first modified example of the embodiment. A regulation portion 40 of the first modified example is provided with a pressing mechanism 47. The pressing mechanism 47 presses the joint portion 13 toward the first mold 112 in the crimping process.

The pressing mechanism 47 includes a pressing member 44, a slide member 45, and elastic members 46. The pressing member 44 is a stick-shaped member, and is a columnar-shaped member, for example. The slide member 45 is a plate-shaped member, and is formed into an oblong, for example. The slide member 45 is disposed in a through-hole 40*c* of the regulation portion 40. The through-hole 40*c* penetrates through the regulation portion 40 in the plate thickness direction. For example, the shape of the through-hole 40*c* is an oblong. The slide member 45 is slidable in the third direction H inside the through-hole 40*c*. The elastic members 46 are members that press the slide member 45 downward, and are coil springs, for example. In this modified example, two elastic members 46 are provided.

The regulation portion 40 is provided with a communication hole 40*d* that communicates the through-hole 40*c* and the recessed portion 43. The pressing member 44 is inserted into the communication hole 40*d*. The proximal end of the pressing member 44 is fixed to the bottom surface of the slide member 45. The distal end of the pressing member 44 protrudes downward from the communication hole 40*d*. The pressing member 44 relatively moves up and down with respect to the regulation portion 40 integrally with the slide member 45.

As illustrated in FIG. 23, in the crimping process, the pressing member 44 comes into contact with an inner side surface of the joint portion 13. The pressing member 44 presses a bottom portion of the joint portion 13 toward the first mold 112. The pressing member 44 presses the joint portion 13 downward by force applied according to the biasing force of the elastic members 46. Thus, the joint portion 13 is not only supported by the regulation portion 40 from the both sides in the second direction W, but also pressed by the pressing member 44 toward the first mold 112. Thus, a movement such as rolling of the joint portion 13 is preferably suppressed.

Second Modified Example of Embodiment

A second modified example of the embodiment will be described. The shapes, dimensions, and the like of the crimping terminal 1 and the regulation portion 40 are not limited to those exemplified. For example, an interval between the pair of wall surfaces 41 and 41 of the regulation portion 40 may be set to become narrower toward a rear portion of the recessed portion 43.

In the pair of wall surfaces 41 and 41 of the regulation portion 40, an interval between the first regions 41*a* and 41*a* and an interval between the second regions 41*b* and 41*b* may be different. For example, an interval between the second regions 41*b* and 41*b* may be made narrower than an interval between the first regions 41*a* and 41*a*.

The pair of wall surfaces 41 and 41 of the regulation portion 40 need not include the first regions 41*a* that support the terminal connection portion 11.

The matters disclosed in the above-described embodiment and the modified example can be executed while being appropriately combined.

A terminal crimping apparatus according to the embodiment includes a regulation portion configured to regulate a width of a joint portion so as not to be wider than a width of a terminal connection portion, by sandwiching the joint portion from both sides in a width direction when a second mold crimps a wire connection portion. The terminal crimping apparatus according to the present invention brings about such an effect that deformation of a crimping terminal in crimping can be suppressed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A manufacturing method of a crimping terminal comprising:

a terminal supply step of supplying the crimping terminal to a crimping position with a wire by a terminal supply device, the crimping terminal including a terminal connection portion to be connected to a counterpart terminal, a wire connection portion to be crimped onto the wire, and a joint portion linking side walls of the terminal connection portion and the wire connection portion along an axial direction of the wire;

a support step of supporting a bottom portion of the crimping terminal supplied to the crimping position by a first mold;

a crimp step of deforming the wire connection portion while relatively moving toward the first mold, and crimping the wire connection portion onto a core wire of the wire by a second mold; and a regulation step of regulating a width of the joint portion so as not to be wider than a width of the terminal connection portion, by sandwiching each of the joint portion and the terminal connection portion from both sides in a width direction by a regulation portion when the second mold crimps the wire connection portion.

2. The manufacturing method of the crimping terminal according to claim 1, wherein the regulation portion includes a pair of wall surfaces configured to sandwich the joint portion from the both sides in the width direction, and a width of a clearance gap between the pair of wall surfaces corresponds to a width of the terminal connection portion.

3. The manufacturing method of the crimping terminal according to claim 1, wherein the regulation portion includes a pair of wall surfaces facing each other in a width direction of the crimping terminal, the pair of wall surfaces include first regions facing side walls of the terminal connection portion, and second regions facing side walls of the joint portion, and when the second mold crimps the wire connection portion, a timing at which the first regions start to face the side walls of the terminal connection portion is earlier than a timing at which the second regions start to face the side walls of the joint portion.

4. The manufacturing method of the crimping terminal according to claim 1, wherein the regulation portion moves integrally with the second mold.

5. The manufacturing method of the crimping terminal according to claim 2, wherein the regulation portion moves integrally with the second mold.

6. The manufacturing method of the crimping terminal according to claim 3, wherein the regulation portion moves integrally with the second mold.

7. The manufacturing method of the crimping terminal according to claim 1, further comprising:

a press step of pressing a bottom portion of the joint portion toward the first mold by a pressing mechanism provided in the regulation portion.

8. The manufacturing method of the crimping terminal according to claim 2, further comprising:

a press step of pressing a bottom portion of the joint portion toward the first mold by a pressing mechanism provided in the regulation portion.

9. The manufacturing method of the crimping terminal according to claim 3, further comprising:

a press step of pressing a bottom portion of the joint portion toward the first mold by a pressing mechanism provided in the regulation portion.

10. The manufacturing method of the crimping terminal according to claim 4, further comprising:

a press step of pressing a bottom portion of the joint portion toward the first mold by a pressing mechanism provided in the regulation portion.

11. The manufacturing method of the crimping terminal according to claim 5, further comprising:

a press step of pressing a bottom portion of the joint portion toward the first mold by a pressing mechanism provided in the regulation portion.

12. The manufacturing method of the crimping terminal according to claim 6, further comprising:

a press step of pressing a bottom portion of the joint portion toward the first mold by a pressing mechanism provided in the regulation portion.

* * * * *